US007357880B2

(12) United States Patent
Honkura et al.

(10) Patent No.: US 7,357,880 B2
(45) Date of Patent: Apr. 15, 2008

(54) COMPOSITE RARE-EARTH ANISOTROPIC BONDED MAGNET, COMPOSITE RARE-EARTH ANISOTROPIC BONDED MAGNET COMPOUND, AND METHODS FOR THEIR PRODUCTION

(75) Inventors: Yoshinobu Honkura, Tokai (JP); Norihiko Hamada, Tokai (JP); Hironari Mitarai, Tokai (JP); Kenji Noguchi, Tokai (JP)

(73) Assignee: Aichi Steel Corporation, Tokai-shi (JP)

( * ) Notice: Subject to any disclaimer, the term of this patent is extended or adjusted under 35 U.S.C. 154(b) by 420 days.

(21) Appl. No.: 10/714,918

(22) Filed: Nov. 18, 2003

(65) Prior Publication Data

US 2005/0076974 A1 Apr. 14, 2005

(30) Foreign Application Priority Data

Oct. 10, 2003 (JP) ..... 2003-353018

(51) Int. Cl.
*H01F 1/032* (2006.01)
*H01F 1/053* (2006.01)

(52) U.S. Cl. ..... 252/62.54; 148/302; 148/104

(58) Field of Classification Search ..... None
See application file for complete search history.

(56) References Cited

U.S. PATENT DOCUMENTS 4,851,058 A 7/1989 Croat
5,411,608 A 5/1995 Hazelton et al.
6,814,776 B2 * 11/2004 Kanekiyo et al. ..... 75/244
2003/0019546 A1 * 1/2003 Kanekiyo et al. ..... 148/105
2005/0076974 A1 4/2005 Honkura et al.

FOREIGN PATENT DOCUMENTS

| | | | |
|---|---|---|---|
| EP | 0 654 801 | | 5/1995 |
| EP | 1 191 553 | | 3/2002 |
| JP | 05-055020 | * | 3/1993 |
| JP | 5-152116 | | 6/1993 |
| JP | 6-61023 | | 3/1994 |

(Continued)

OTHER PUBLICATIONS

Machine Translation of Japanese Patent Document No. 2000-003809.*

(Continued)

*Primary Examiner*—John P. Sheehan
(74) *Attorney, Agent, or Firm*—Oblon, Spivak, McClelland, Maier & Neustadt, P.C.

(57) ABSTRACT

The bonded magnet of the present invention, in which average particle diameter and compounding ratio are specified, is comprised of Cobalt-less R1 d-HDDR coarse magnet powder that has been surface coated with surfactant, R2 fine magnet powder that has been surface coated with surfactant (R1 and R2 are rare-earth metals), and a resin which is a binder. The resin, a ferromagnetic buffer in which R2 fine magnet powder is uniformly dispersed, envelops the outside of the Cobalt-less R1 d-HDDR coarse magnet powder. Despite using Cobalt-less R1 d-HDDR anisotropic magnet powder, which is susceptible to fracturing and therefore vulnerable to oxidation, the bonded magnet of the present invention exhibits high magnetic properties along with extraordinary heat resistance.

12 Claims, 7 Drawing Sheets

Bonded Magnet of the Present Invention

FOREIGN PATENT DOCUMENTS

| | | | |
|---|---|---|---|
| JP | 6-132107 | | 5/1994 |
| JP | 9-92515 | | 4/1997 |
| JP | 9-115711 | | 5/1997 |
| JP | 9-312230 | | 12/1997 |
| JP | 9-320876 | | 12/1997 |
| JP | 9-330842 | | 12/1997 |
| JP | 10-32134 | | 2/1998 |
| JP | 2000-003809 | * | 1/2000 |
| JP | 2001-76917 | | 3/2001 |

OTHER PUBLICATIONS

Machine Translation of Japanese Patent Document No. 06-132107.*

Takuo Takeshita, "Some Applications of Hydrogenation-Decomposition-Desorption-Recombination (HDDR) and Hydrogen-Decrepitation (HD) in Metals Processing", Journal of Alloys and Compounds, vol. 231, 1995, pp. 51-59.

U.S. Appl. No. 10/509,687, filed Oct. 12, 2004, Honkura, et al.

* cited by examiner

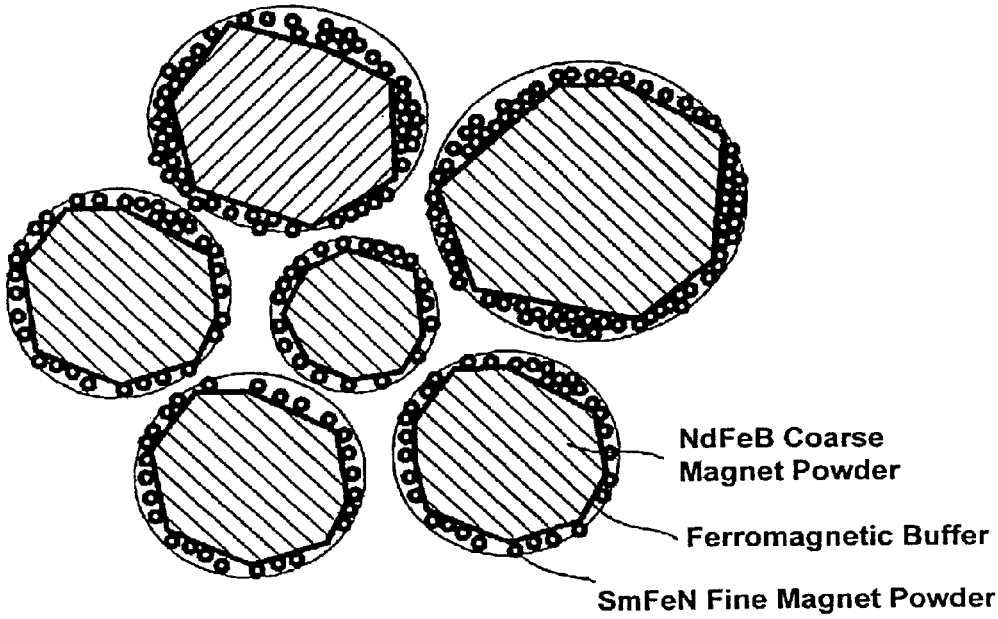
Fig. 1A Compound of the Present Invention
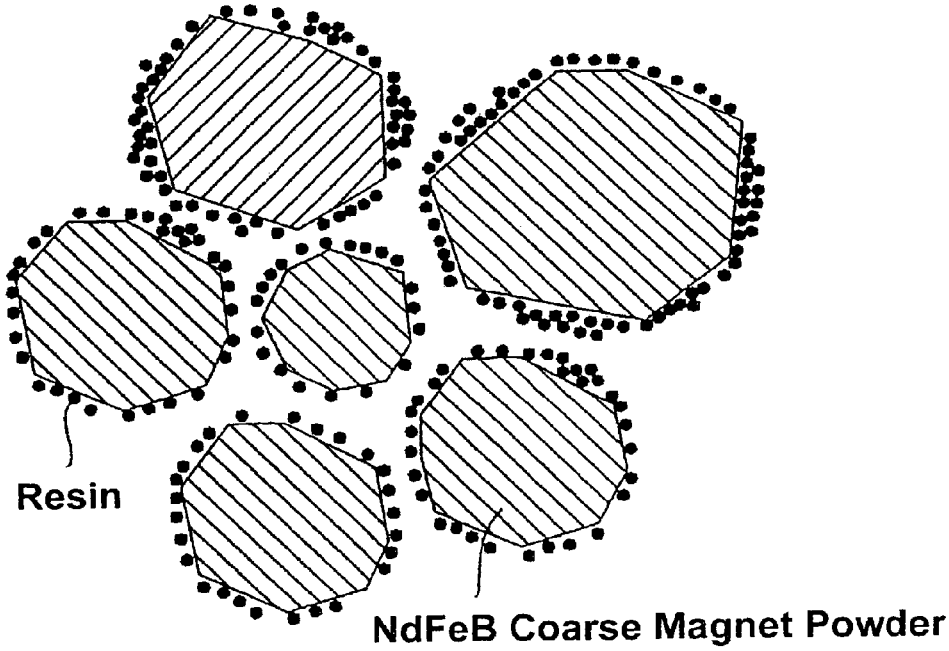
Fig. 1B Conventional Compound

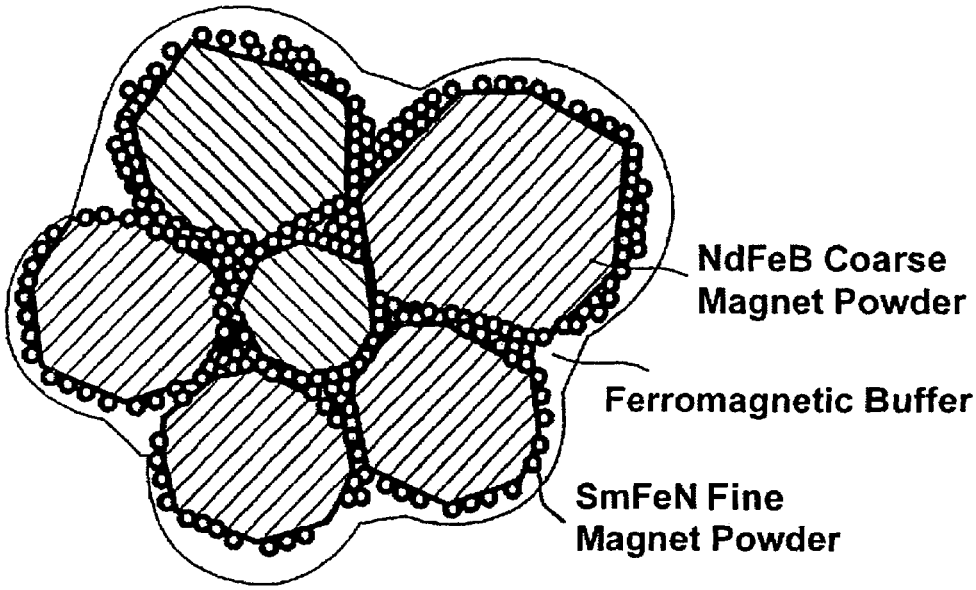
Fig. 2A Bonded Magnet of the Present Invention
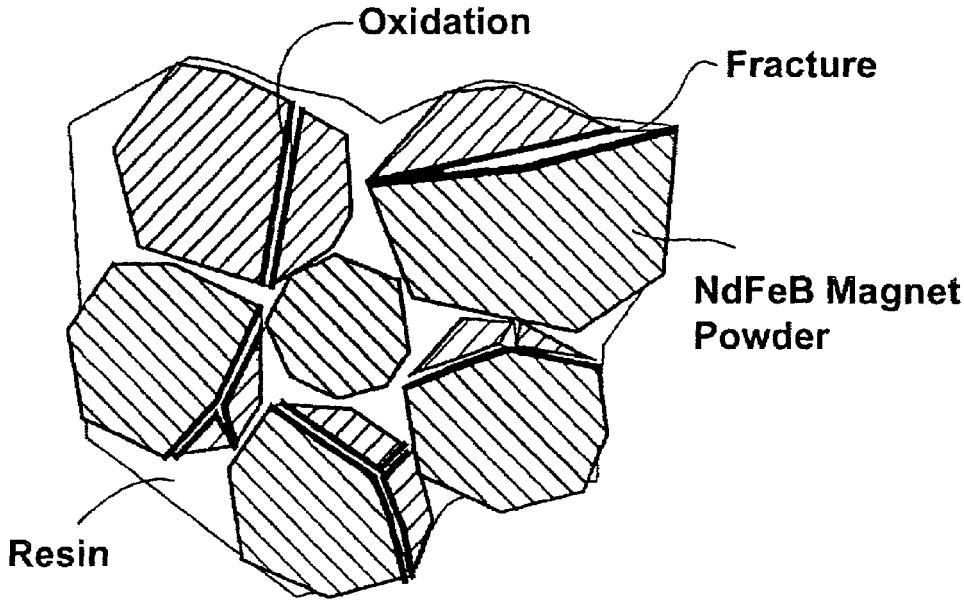
Fig. 2B Conventional Bonded Magnet

COMPOSITE RARE-EARTH ANISOTROPIC BONDED MAGNET, COMPOSITE RARE-EARTH ANISOTROPIC BONDED MAGNET COMPOUND, AND METHODS FOR THEIR PRODUCTION

BACKGROUND OF THE INVENTION

1. Technical Field of the Invention

The present invention relates to a composite rare-earth anisotropic bonded magnet having both excellent magnetic properties and extremely low aging loss, a compound employed in that magnet, and methods for their production.

2. Background Art

In recent years, with the increasing need for various types of motors and magnetic actuators with higher performance/smaller size, an improvement in the magnetic properties used in these motors and magnetic actuators has been sought. Above all, there is a strong need for higher-specification rare-earth magnets with outstanding magnetic properties. In particular, performance improvements in rare-earth anisotropic bonded magnets, which possess the traits of high size-accuracy and integral molding, have been strongly sought.

The magnetic properties and heat resistance of rare-earth anisotropic bonded magnets (hereafter, "bonded magnets") will be explained below.

At present, RFeB rare-earth magnets comprised of rare-earth elements (R), boron (B), and iron (Fe) are being actively developed in the search for better magnetic properties. For example, RFeB magnetic alloys (composition) having magnetic isotropy were made public in patent document 1 (U.S. Pat. No. 4,851,058) and patent document 2 (U.S. Pat. No. 5,411,608), applications dated about twenty years ago.

However, conventional rare-earth magnets easily deteriorate, due to the oxidation of R and Fe which are their main ingredients, and their initial magnetic properties are not stable over time. In particular, when using rare-earth magnets above room temperature, magnetic properties decline. Ordinarily, aging loss is quantitatively indicated by the irreversible loss rate (%). The irreversible loss rate is the loss of magnetic flux which can not be recovered even after remagnetizing, following the passage of a long period of time (more than 1000 hours) at high temperature (100° C. or 120° C.). The irreversible loss rate of most conventional rare-earth anisotropic magnets is more than −10 percent.

Also, when producing rare-earth anisotropic bonded magnets from the magnet alloys made public in patent documents 1 or 2, it is necessary to confer anisotropy by crushing a magnet alloy made via melt spinning method, and then hot-pressing the crushed material. However, the magnetic properties of that magnet powder are low, and therefore the magnetic properties of bonded magnets obtained from that powder are naturally inadequate.

Aiming for further improvement in the magnetic properties of bonded magnets, the below-mentioned patent documents 3-11 propose a molded bonded magnet made by mixing magnet powder which has a plurality of different grain diameters with a binding resin. In this bonded magnet, because magnet powder with a small grain diameter enters into the empty gaps of a magnet powder with large grain diameter, the filling factor (relative density) for the whole is high, and magnetic properties are excellent. In particular, the composite rare-earth anisotropic bonded magnet, in which anisotropic magnet powder is molded within a magnetic field, manifests outstanding magnetic qualities. Below, the bonded magnet made public in each patent document will be individually explained.

In patent document 3 (Japanese patent application Laid-Open (Kokai) No. 5-152116), a bonded magnet is made public in which an epoxy binder resin is added to a mixture of magnet powder combining, in a wide variety of ratios, magnet powder made from an $Nd_2Fe_{14}B$ alloy and having a grain diameter of 500 μm or less (hereafter, "NdFeB magnet powder"), and magnet powder made from an $Sm_2Fe_{17}N$ alloy and having a grain diameter of 5 μm or less (hereafter, "SmFeN magnet powder"). The mixture is molded in a magnetic field, and the resin is then heat-hardened. This composite rare-earth anisotropic bonded magnet, by improving the filling factor of the whole, has a maximum energy product (BH)max of 128 kJ/m$^3$, improving magnetic properties over bonded magnets made from simple NdFeB magnet powder whose maximum energy product (BH)max is 111 kj/m$^3$. The grain diameter of NdFeB magnet powder was decided after carefully considering that magnetic properties deteriorate when the $Nd_2Fe_{14}B$ alloy is simply fine ground, and the grain diameter of SmFeN magnet powder was decided after carefully considering the single domain particle coercive force structure of SmFeN magnet powder.

In patent document 4 (Japanese patent application Laid-Open (Kokai) No. 6-61023), a composite rare-earth anisotropic bonded magnet is made public in which a mixture of SmFeN magnet powder, SmCo magnet powder, and/or NdFeB magnet powder, and a lubricant or coupling agent and epoxy resin is press molded within a magnetic field. The contents of this disclosure, except for the point of using a coupling agent, do not differ greatly from the above-mentioned patent document 3. Specifically, the maximum energy product (BH) of this bonded magnet is not more than about 110 kJ/m$^3$. In addition, in patent document 3 and patent document 4, only the magnetic properties are disclosed; nothing is recited with respect to those magnets' heat resistance or irreversible loss rate.

In patent document 5 (Japanese patent application Laid-Open (Kokai) No. 6-132107) as well, just as in above-mentioned patent document 3, a bonded magnet is disclosed which molds a mixture of NdFeB magnet powder, SmFeN magnet powder, and binder resin within a magnetic field. However, in this patent document, nothing is concretely disclosed concerning the magnetic properties or production process of the magnet powder, which exert a large influence on the magnetic properties of the bonded magnet. The maximum energy product (BH)max of the bonded magnet mentioned in the example embodiment is as much as 239 (30.3 MGOe) kJ/m$^3$, but considering the level of technology at the time of the application, that manner of unusually high magnetic properties is not possible. Accordingly, the credibility of the data disclosed in patent document 5 as a whole is very low. For example, in chart 1 of patent document 5, looking at the value of Br for each sample, a (BH)max value equivalent to the theoretical value has been cited.

Additionally, the (BH)max value of sample no. 22 exceeds the theoretical value by 0.5 MGOe. Making an actual calculation, the value of residual magnetic flux density (Br) is 9.7 KG, and the (BH)max theoretical value of $(Br/2)^2$ yields 23.5 MGOe. In contrast, the value of (BH)max in the patent document is 24.0 MGOe, plainly surpassing the theoretical value, so that a value that cannot in reality exist is cited in the patent document. Furthermore, the theoretical value is calculated based on ideal conditions with squareness of 100%, and in this case the squaring ratio of NdFeB anisotropic magnet powder and SmFeN anisotropic magnet powder is not more than about 40-70%. This sort of disclosure places the veracity of the information in that patent document in doubt. Moreover, in patent document 5, nothing is disclosed with respect to the heat resistance or irreversible loss ratio of the bonded magnet.

Incidentally, heat processing of ribbon fragments made by melt spinning method was performed on the NdFeB magnet powder used in each above-stated bonded magnet to make the powder anisotropic, but the anisotropy conferred was inadequate. Separately, a hydrogenation treatment process (HDDR process) which produces anisotropic magnet powder was developed. Composite rare-earth anisotropic bonded magnets using magnet powder made from this HDDR process (hereafter, "HDDR magnet powder") are disclosed in patent documents 6-11 mentioned below.

In patent document 6 (Japanese patent application Laid-Open (Kokai) No. 9-92515), a bonded magnet is disclosed in which (1) HDDR magnet powder, including Co, with an average grain diameter of 150 μm, having an aggregate structure of re-crystallized grains comprised of $Nd_2Fe_{14}B$ tetragonal phase, and (2) 0-50 wt % ferrite magnet powder comprised of $SrO.6Fe_2O_3$ with an average grain size of 0.5 to 10.7 μm, and (3) 3 wt % of epoxy resin are mixed at room temperature, vacuum dehydrated, molded within a magnetic field and heat-hardened.

Here, the above-mentioned Co is a necessary element for conferring anisotropy on the above-mentioned HDDR magnet powder. Further, by including Co, the temperature properties of HDDR magnet powder are improved, and the heat resistance of the bonded magnet increases. This was also introduced in non-patent document 1.

The bonded magnet disclosed in the embodiments of patent document 6 shows excellent magnetic properties and heat resistance, for example maximum energy product (BH) max 132-150.14 kJ/m$^3$, and irreversible ageing loss (100° C.×1000 hours) −3.5 to −5.6%. However, these magnetic properties are not much different from those of material molded with the above-mentioned Co-containing HDDR magnet powder simple. In other words, the merits of a composite magnet powder are not expressed in the magnetic properties.

Patent document 6 explains the advantages of making a bonded magnet by mixing two types of magnet powder with different grain diameters as follows. When molding a bonded magnet, the result of having ferrite magnet powder preferentially fill the grain gaps of NdFeB magnet powder which is HDDR magnet powder is that the air gap percentage will decrease. In this way, (a) intrusion of $O_2$ and $H_2O$ into the bonded magnet is controlled, improving heat resistance; (b) parts that were air gaps are permutated by ferrite magnet powder, improving magnetic properties; and (c) as a result of the ferrite magnet powder mitigating the stress concentration on the NdFeB magnet powder generated when molding the bonded magnet, fracturing of the NdFeB magnet powder is controlled. Thereby, exposure of exceptionally active fractured metal surfaces in the bonded magnet is controlled, and the heat resistance of the bonded magnet is further improved. Moreover, by mitigating the stress concentration with ferrite magnet powder, the importing of deformations into the magnet powder is controlled, further improving magnetic properties.

This patent document mentions that a decrease in irreversible loss rate (lowering heat resistance) is caused by fractures in the magnet powder, but also states that a surfactant does not have the effect of improving heat resistance, and there is no example embodiment using a surfactant.

In patent document 7 (Japanese patent application Laid-Open (Kokai) No. 9-115711) a bonded magnet is disclosed which uses, in place of the ferrite magnet powder of above-mentioned patent document 6, isotropic nano-composite magnet powder with an average grain diameter of 3.8 μm, comprised of (1) soft magnetic phase including body-centered cubic iron with average crystalline grain diameter 50 nm or less and iron boride, and (2) hard magnetic phase having $Nd_2Fe_{14}B$-form crystal. This bonded magnet has a maximum energy product (BH)max of 136.8 to 150.4 kJ/m$^3$. The magnetic properties are more or less improved over patent document 6, but still insufficient. Although the bonded magnet has excellent heat resistance with irreversible loss rate −4.9 to −6.0%, this depends on the inclusion of Co.

Patent document 7 also discloses, as a comparison example, a bonded magnet which is made of Co-containing NdFeB magnet powder and SmFeN magnet powder with a smaller grain diameter than that of the NdFeB powder. This bonded magnet, although it has a maximum energy product (BH)max of 146.4 to 152.8 kJ/m$^3$ and initial magnetic properties are excellent, irreversible loss rate is −13.7 to −13.1%. Heat resistance is worse than in bonded magnets made from Co-containing NdFeB magnet powder simple (irreversible aging loss rate: −10.4 to −11.3%).

Patent document 7 attributes that problem to oxidation of the SmFeN magnet powder. As a result, the idea of making a composite with SmFeN magnet powder in order to improve the heat resistance of bonded magnets made from Co-containing HDDR magnet powder was abandoned. Below-mentioned patent documents 8 through 11 make this clear.

In patent document 8 (Japanese patent application Laid-Open (Kokai) No. 9-312230), patent document 9 (Japanese patent application Laid-Open (Kokai) No. 9-320876), patent document 10 (Japanese patent application Laid-Open (Kokai) No. 9-330842), and patent document 11 (Japanese patent application Laid-Open (Kokai) No. 10-32134), a bonded magnet is disclosed which makes a composite of Co-containing HDDR magnet powder and another magnet powder (ferrite magnet powder, nano-composite, melt spun NdFeB magnet powder, etc.) with a grain diameter smaller than that of the HDDR powder. These bonded magnets are made by mixing each magnet powder at a normal temperature, and then within a temperature range above the softening point of the heat-hardened resin and below the point where hardening begins, molding within a magnetic field while at temperature. By molding within a magnetic field at temperature, magnet powder fluidity improves, and as a result of the filling factor of the whole and mitigating stress concentration between grains of magnet powder, the obtained bonded magnet exhibits excellent magnetic properties and heat resistance, with a maximum energy product (BH)max of 142.5 to 164.7 kJ/m$^3$ and irreversible loss rate of −2.6 to −4.7%.

However, when looking at the amount of improvement in maximum energy product (BH)max due to using composite magnet powder for each fine powder individually, compared to Co-containing HDDR magnet powder simple, composite ferrite magnet powder shows improvement of 5.1-5.3%, composite melt spun NdFeB magnet powder improvement of 9.3 12.7%, and a composite of melt spun NdFeB magnet powder and Sr ferrite magnet powder shows improvement of 5.0 5.6%. In all cases the improvement in magnetic properties is small. Regardless of ample improvement in irreversible loss rate, the lack of improvement in maximum energy product (BH)max is thought due to the fact that the magnetic properties of the above-mentioned magnetic powder used for making a composite are quite inferior to the primary Co-containing HDDR magnet powder.

Co is a necessary element in the Co-containing HDDR magnet powder used in the above-stated patent documents 6-11, but it is widely known that because Co is a scarce resource, it is costly and not in steady supply. Accordingly, the above-stated Co-containing HDDR magnet powder is not desirable when aiming at enlarged demand for bonded magnets. Development of a bonded magnet using Co-less anisotropic magnet powder, while providing magnetic properties and heat resistance the same or greater as a magnet using Co-containing anisotropic magnet powder, is much desired.

The present invention develops a new hydrogenation process, the d-HDDR process, in place of the above-mentioned HDDR process, and despite not containing Co, succeeds at making anisotropic RFeB magnet powder. The contents of this d-HDDR process, by way of example, are specifically disclosed in patent document 12 (Japanese patent application Laid-Open (Kokai) No. 2001-76917). The contents of this process will also be stated later in the present specification.

The bonded magnet comprised of anisotropic magnet powder simple (hereafter, "d-HDDR anisotropic magnet powder") made through this process has a maximum energy product (BH)max of 137.7-179.1 kJ/m$^3$. It presently displays the highest magnetic properties of any bonded magnet made from Co-less magnet powder.

When d-HDDR anisotropic magnet powder does not contain Co, the oxidation resistance effect provided by Co can not be expected. Furthermore, constituent grains of the d-HDDR anisotropic powder are easily fractured during bonded magnet molding, because this powder has a higher sensitivity to fracturing than melt spun magnet powder due to having cracks generated at the time of hydrogen pulverization. When fractures occur in the constituent grains, the fracture surface is markedly oxidized, and the irreversible loss rate of the bonded magnet greatly deteriorates. Specifically, even though molded at temperature within a magnet field, bonded magnets comprised of Co-less d-HDDR anisotropic magnet powder alone, as an example, have irreversible loss rates (100° C.×1000 hr) no better than −23.0 to −18.0% when coercive force is 880-1040 kA/m. In particular, for the 120° C.×1000 hr called for in automotive environments, irreversible loss rate is notably worse at −28.0 to −35.0%. The present invention was made with this information in mind.

More specifically, the present invention furnishes a composite rare-earth anisotropic bonded magnet using Co-less d-HDDR anisotropic magnet powder and a method for its production; the magnet has high initial magnetic properties and provides ample heat resistance the same or greater than bonded magnets using Co-containing HDDR magnet powder. Further, the present invention furnishes a composite rare-earth anisotropic bonded magnet that provides ample heat resistance at temperatures of 120° C. and a method for its production. Also, the present invention furnishes, as raw material for such a bonded magnet, an ideal compound for a composite rare-earth anisotropic bonded magnet and a method for producing the compound.

Patent Document 1:
U.S. Pat. No. 4,851,058
Patent Document 2:
U.S. Pat. No. 5,411,608
Patent Document 3:
Japanese patent application Laid-Open (Kokai) No. 5-152116
Patent Document 4:
Japanese patent application Laid-Open (Kokai) No. 6-61023
Patent Document 5:
Japanese patent application Laid-Open (Kokai) No. 6-132107
Patent Document 6:
Japanese patent application Laid-Open (Kokai) No. 9-92515
Patent Document 7:
Japanese patent application Laid-Open (Kokai) No. 9-115711
Patent Document 8:
Japanese patent application Laid-Open (Kokai) No. 9-312230
Patent Document 9:
Japanese patent application Laid-Open (Kokai) No. 9-320876
Patent Document 10:
Japanese patent application Laid-Open (Kokai) No. 9-330842
Patent Document 11:
Japanese patent application Laid-Open (Kokai) No. 10-32134
Patent Document 12:
Japanese patent application Laid-Open (Kokai) No. 2001-76917
Non-Patent Document 1:
Journal of Alloys and Compounds 231 (1995) 51-59 (particularly, pgs. 54-55)

SUMMARY OF THE INVENTION

The inventor of the present invention diligently researched a way to solve this problem, and as a result of accumulated trial and error, contrary to the technology's conventional wisdom, combined coarse Co-less NdFeB anisotropic magnet powder, which has poor resistance to oxidation, with fine SmFeN anisotropic magnet powder having similarly poor oxidation resistance, and thereby succeeded at obtaining a composite rare-earth anisotropic bonded magnet which naturally has excellent initial magnetic properties, and exhibits ample heat resistance (irreversible loss properties) the same or greater than bonded magnets that use Co-containing anisotropic magnet powder.

Through the development of this new composite rare-earth anisotropic bonded magnet, the inventor realized that generally the same result was obtained with Co-less R1 d-HDDR coarse magnet powder and R2 fine magnet powder containing SmFeN magnet powder, and completed the present invention.

(Composite Rare-Earth Anisotropic Bonded Magnet)

The composite rare-earth anisotropic bonded magnet of the present invention is a bonded magnet comprising:

(A) Cobalt-less R1 d-HDDR coarse powder with an average grain diameter of 40-200 μm, comprising:
   1. Cobalt-less R1 d-HDDR anisotropic magnet powder, obtained by performing a d-HDDR treatment on a cobalt-less R1 alloy of a rare-earth element including yttrium (Y) (hereafter, "R1"), iron (Fe) and boron (B) as the main ingredients and fundamentally not containing cobalt; and
   2. #1 surfactant that coats at least one part of the grain surface of said cobalt-less R1 d-HDDR anisotropic magnet powder; and (B) R2 fine magnet powder with an average aspect ratio of 2 or less and average grain diameter 1-10 μm, comprising:

1. R2 anisotropic magnet powder with a maximum energy product (BH)max 240 kJ/m$^3$ or more and with a rare-earth element including yttrium (hereafter, "R2") as one of the principle ingredients; and
2. #2 surfactant that coats at least one part of the grain surface of said R2 anisotropic magnet powder and (C) a resin as binder.

Included in the said bonded magnet is 50-84 wt % of said cobalt-less R1 d-HDDR coarse magnet powder, 15-40 wt % of said R2 fine magnet powder, and 1-10 wt % of said resin. Relative density ($\rho/\rho_{th}$) of the said bonded magnet, which is the ratio of volume density ($\rho$) to theoretical density $\rho_{th}$), is 91-99%. The said composite rare-earth anisotropic bonded magnet has outstanding magnetic properties and heat resistance, including the special feature that the cobalt-less R1 d-HDDR coarse magnet powder in the said composite rare-earth anisotropic bonded magnet has a normalized grain count, where per unit area apparent grain diameter is 20 μm or less, of $1.2\times10^9$ pieces/m$^2$ or less.

The composite rare-earth anisotropic bonded magnet of the present invention (hereafter, "bonded magnet") shows outstanding initial magnetic properties not presently available, and at the same time, shows outstanding heat resistance with extremely low aging loss even when used in high temperature environments. In other words, the bonded magnet of the present invention exhibits high magnetic properties stable over a long period of time.

To demonstrate, examples of the bonded magnet of the present invention show high initial magnetic properties, such as maximum energy product (BH)max of 167 kJ/m$^3$ or more, 180 kJ/m$^3$ or more, 190 kJ/m$^3$ or more, 200 kJ/m$^3$ or more, or 210 kJ/m$^3$ or more. And examples of the bonded magnet of the present invention show outstanding heat resistance, with irreversible loss rates of −6% or less, −5% or less, or −4.5% or less. This irreversible loss rate is the proportion of magnetic flux loss which can not be recovered even with remagnetizing, following the passage of 1000 hours at 100° C. The irreversible loss rate for 1000 hours at 120° C. is −7% or less, −6% or less, or −5.5% or less, again showing outstanding heat resistance.

"Co-less" in Co-less R1 d-HDDR anisotropic magnet powder, Co-less R1 d-HDDR coarse magnet powder and Co-less R2 d-HDDR anisotropic magnet powder means that even though the magnet powder fundamentally does not contain Co, anisotropy is manifested due to the d-HDDR treatment and magnetic properties are outstanding. It does not mean that the anisotropic magnet powder contains no Co at all. Some amount of Co may be included in Co-less R1 d-HDDR anisotropic magnet powder or Co-less R2 d-HDDR anisotropic magnet powder, to further increase the magnetic properties and heat resistance of the bonded magnet. In concrete terms, it is acceptable if the Co-less R1 d-HDDR anisotropic magnet powder includes 1.0 at % to 6.0 at % of Co. By doing so it is possible to improve the Curie point of the Co-less R2 d-HDDR anisotropic magnet powder. It is desirable for the Co-less R1 d-HDDR anisotropic powder of the present invention to have a (BH)max of 279.3 kJ/m$^3$ or more, or 320 kJ/m$^3$ or more, and for the R2 anisotropic magnet powder to have a (BH)max of 240 kJ/m$^3$ or more, or 303.2 kJ/m$^3$ or more.

The R2 fine magnet powder of the present invention can be comprised of R2 anisotropic magnet powder with a (BH)max of 240 kJ/m$^3$, irrespective of its composition or production process. For this R2 anisotropic magnet powder, Co-less R2 d-HDDR anisotropic magnet powder is used. Such powder is obtained by performing a d-HDDR process on SmFeN anisotropic magnet powder having samarium (Sm), iron (Fe), and nitrogen (N) as its main ingredients, or on a Co-less R2 alloy having R2, Fe, and B as its main ingredients and fundamentally not including Co. Below, for the sake of simplicity, SmFeN anisotropic magnet powder is taken up and explained as one example of R2 anisotropic magnet powder, but this does not mean that R2 anisotropic magnet powder is limited to SmFeN anisotropic magnet powder.

The "d-HDDR treatment" in the present specification essentially involves four stages. A type of hydrogenation treatment, it includes a low temperature hydrogenation stage (stage no. 1), high temperature hydrogenation stage (stage no. 2), no. 1 evacuation stage (stage no. 3), and no. 2 evacuation stage (stage no. 4). Co-less R1 d-HDDR anisotropic magnet powder and Co-less R2 d-HDDR anisotropic magnet powder are obtained by performing this d-HDDR treatment on the ingredient alloy. For these d-HDDR anisotropic magnet powders, as long as the four essential stages stated above are performed, other stages may also performed, such as additions after the above stages are complete, insertions in the midst of those four stages, or others occurring later. One example is a diffusion heat treatment process which diffuses a rare earth element (R3) or Lanthanum (La) in the d-HDDR anisotropic magnet powder. The details of each stage will be described later.

"d-HDDR" is an abbreviation of "dynamic-Hydrogenation-Decomposition-Disproportionation-Recombination". This is a technical term also appearing in the "Dictionary of Electronic Components" (Kogyochosakai Pub. Ltd., 2002).

The bonded magnet of the present invention obtains a high level of both magnetic properties and corrosion resistance, but to meet the requirements of bonded magnet applications, it is acceptable if just one of these two properties is further increased. For example, for bonded magnets used in a high temperature environment, there are times when corrosion resistance is prioritized over magnetic properties. In such an instance corrosion resistance should be increased until irreversible loss rate is −4% or less, or −3.5% or less, while magnetic properties (BH)max are 160-165 kJ/m$^3$. Also, if designing for lower cost by abbreviating the homogenization heat treatment, La may be included to improve corrosion resistance, or large amounts of B even from conventional RFeB anisotropic magnet powder may be included. For this sort of bonded magnet, corrosion resistance should be increased until the irreversible loss rate is −4% or less, or −3.5% or less, while magnetic properties (BH)max are 140-160 kJ/m$^3$.

(Production Method for Composite Rare-Earth Anisotropic Bonded Magnet)

The above-mentioned bonded magnet of the present invention can be, for example, produced with the following type of production method of the present invention.

A production method for the composite rare-earth anisotropic bonded magnet of the present invention comprises:

(1) A heat orientation process performed on a compound in which direct contact between grains of the said Co-less R1 d-HDDR coarse magnet powder is avoided by enveloping the grains in a ferromagnetic buffer made by uniformly dispersing the R2 fine magnet powder in resin, the compound comprising:

(A) 50-84 wt % of Cobalt-less R1 d-HDDR coarse magnet powder having an average grain size of 40-200 μm, comprising:

1. Cobalt-less R1 d-HDDR anisotropic magnet powder, obtained by performing a d-HDDR treatment on a cobalt-less R1 alloy with R1, Fe, and B as the main ingredients and fundamentally not containing cobalt; and 2. #1 surfactant that, coats at least one part of the grain surface of said cobalt-less R1 d-HDDR anisotropic magnet powder; and (B) 15-40 wt % of R2 fine magnetic powder with an average aspect ratio of 2 or less and average grain diameter 1-10 μm, comprising:

1. R2 anisotropic magnet powder with a maximum energy product (BH)max of 240 kJ/m$^3$ or more and with R2 as one of the main ingredients; and
2. #2 surfactant that coats at least one part of the grain surface of said R2 anisotropic magnet powder; and (C) 1-10 wt. % of resin as binder, wherein in the heat orientation process the compound is heated above the softening point of the resin which forms the ferromagnetic buffer, and while keeping that ferromagnetic buffer in a softened state or melted state, an orienting magnetic field is applied so that the Co-less R1 d-HDDR coarse magnet powder and R2 fine magnet powder are oriented in a specific direction; and (2) a heat molding process in which, after the heat orientation process or in parallel with the heat orientation process, the compound is heated and press molded.

The normalized grain count of the Co-less R1 d-HDDR coarse magnet powder in the said bonded magnet, where per unit area apparent grain diameter is 20 μm or less, is $1.2\times10^9$ pieces/m$^2$ or less. Relative density ($\rho/\rho_{th}$) of the said bonded magnet, which is the ratio of volume density ($\rho$) to theoretical density ($\rho_{th}$), is 91-99%. This production method obtained a composite rare-earth anisotropic bonded magnet with excellent magnetic properties and heat resistance.

The mechanisms by which the bonded magnet of the present invention will steadily exhibit initial magnet properties, and by which that sort of bonded magnet is obtained from the above-mentioned production method, are not entirely clear, but within the limits of what is presently thought, those mechanisms and their reasons will be explained.

However, the inventor of the present invention feels that the primary cause of deterioration of the bonded magnet's heat resistance is not merely whether or not Co is present, but that oxidation is accelerated by fractures arising in the Co-less R1 d-HDDR anisotropic magnet powder. The inventor feels the main cause of those fractures to be stress concentration on Co-less R1 d-HDDR anisotropic magnet powder. After the diligent research of the inventor of the present invention, it was ascertained that for bonded magnets made from Co-less R1 anisotropic magnet powder (especially, Co-less R1FeB d-HDDR anisotropic magnet powder), the main cause of deterioration in heat resistance is fractures arising in powder grains at the time of compression molding. It is thought that when these fractures occur, unusually active fractured metal surfaces are exposed, accelerating oxidation of the Co-less R1 d-HDDR anisotropic magnet powder, causing age deterioration. In particular, because Co-less R1 anisotropic magnet powder obtained by applying hydrogenation treatment already has micro-cracks and is therefore susceptible to fracturing, fractures are readily caused during molding.

The inventor of the present invention also observed the progression leading up to fractures in the Co-less R1 d-HDDR anisotropic magnet powder. Based on this observation, it is thought that the cause of fracturing is (a) stress concentration on touching parts of grains of Co-less R1 d-HDDR anisotropic magnet powder, and (b) that when grains of Co-less R1 d-HDDR anisotropic magnet powder are directly touching, each touching particle can not easily rotate and change position. It is thought that when that condition is repeated, fractures in the magnet powder grain continue endlessly and heat resistance declines.

Based on this investigation, the inventor of the present invention, in order to prevent fractures in the Co-less R1 d-HDDR anisotropic magnet powder, searched for a dynamic construction that would limit stress concentration arising in the Co-less R1 d-HDDR anisotropic magnet powder during the bonded magnet molding process as much as possible. The inventor hit on the idea of, during compression molding in which fractures easily occur in each constituent particle of Co-less R1 d-HDDR anisotropic magnet powder, molding so that those constituent particles are floating in a fluid layer. Doing so allows those constituent particles to easily flow and change position, minimizing stress concentration between the constituent particles as much as possible, even when using Co-less R1 d-HDDR anisotropic magnet powder which has poor oxidation resistance and a high susceptibility to fracturing.

In order to implement these ideas, the inventor took the following measures in the present invention:

(i) During the molding process, grains of magnet powder with a smaller diameter are evenly dispersed around each grain of Co-less R1 d-HDDR anisotropic magnet powder, so that grains of Co-less R1 d-HDDR anisotropic magnet powder do not directly touch each other. For the small diameter magnet powder (R2 anisotropic magnet powder), a material with high maximum energy product (BH)max was selected in order to not diminish the magnetic properties of the bonded magnet.

(ii) In order to increase the fluidity between each grain of coarse Co-less R1 d-HDDR anisotropic magnet powder and fine R-2 anisotropic magnet powder during that molding process, a state is created in which the grains float in resin having high fluidity. That is, a state wherein a resin with as much fluidity and lubrication as possible lies between each grain of magnet powder, such that the grains of Co-less R1 d-HDDR anisotropic magnet powder and fine R-2 anisotropic magnet powder do not directly touch, nor do grains of Co-less R1 d-HDDR anisotropic magnet powder touch each other. For material in such a state to be easily molded, a surfactant is used that increases the conformability of each grain to the resin. The molding process is performed at a temperature above the softening point of the resin so that the resin can have high fluidity and lubrication. In other words, the bonded magnet is compression molded with a heated die.

(iii) Stress concentration arising in the Co-less R1 d-HDDR anisotropic magnet powder during the molding process is ultimately suppressed and deterred by a pseudo-fluid layer in which the finer R2 anisotropic magnet powder and resin are united. In the present invention, the grain shape of the R2 anisotropic magnet powder is made as close to a spherical shape as possible to further increase the fluidity of the pseudo-fluid layer. When the R2 anisotropic magnet powder is nearly spherical, there are few catching edges, fluidity increases, and stress concentration on magnet powder touching the R2 anisotropic magnet powder is suppressed. Even if the constituent grains of Co-less R1 d-HDDR anisotropic magnet powder touch each other and stress concentration arises between the grains, fine spherical-shaped R2 anisotropic magnet powder lying between those grains will act as a roller. As a result, the constituent grains of Co-less R1 d-HDDR anisotropic magnet powder can more easily move and rotate, and stress concentration is avoided on the Co-less R1 d-HDDR anisotropic magnet powder, which has poor oxidation resistance and is susceptible to fractures. With this in mind, the average aspect ratio of the R2 anisotropic magnet powder is 1 to 2 (2 or less) in the present invention. The aspect ratio is calculated from the grain maximum diameter/minimum diameter. The average of that calculation gives the average aspect ratio. Observations taken using EPMA (electron probe microanalysis) were used to find an average aspect ratio for 100 grains.

The inventor of the present invention, as a result of various sorts of experimentation, brought to completion a production process for the composite rare-earth anisotropic bonded magnet of the present invention that meets all of the above-stated demands. Using Co-less R1 d-HDDR anisotropic magnet powder, the inventor succeeded at obtaining a bonded magnet with high magnetic properties that has the same or greater heat resistance (irreversible loss properties) as bonded magnets made from Co-containing HDDR magnet powder. This sort of outstanding bonded magnet is made obtainable by the appearance of the above-stated pseudo-fluid layer during the heat forming process of the bonded magnet. In this pseudo-fluid layer, called the "ferromagnetic fluid layer" in the present specification, R2 anisotropic magnet powder is uniformly dispersed in softened or melted resin. The ferromagnetic fluid flayer of the present invention means both this ferromagnetic fluid layer, and the hardening or solidifying of the ferromagnetic fluid layer. To say it the other way around, the ferromagnetic buffer in a hardened state is softened or melted to become the ferromagnetic fluid layer.

The outstanding heat resistance of the composite rare-earth anisotropic bonded magnet of the present invention is indirectly indicated by the relative density of the bonded magnet, and by the normalized grain count of the Co-less R1 d-HDDR coarse magnet powder, where per unit area apparent grain diameter in the bonded magnet is 20 μm or less.

First, "normalized grain count where per unit area apparent grain diameter is 20 μm or less" will be explained.

"Apparent grain diameter" means the actually measured grain diameter per unit cross-sectional area of an optional bonded magnet cross-section. I.e., it means the two-dimensional grain diameter when cutting along a face of the bonded magnet, and using a specified method to measure the grain diameter of Co-less R1 d-HDDR coarse magnet powder revealed in that cross-section. It is not the three dimensional grain diameter obtained by measuring the grain itself. The actual measuring method of the "apparent grain diameter" will be explained. First, the bonded magnet is cut in approximately the middle, and the obtained cross section is polished to a mirrored surface. That surface is analyzed by EPMA, R1 (for example, Nd) and R2 (for example, Sm) are analyzed, and a mapped image is obtained. For this image 200-600 times magnification is desirable.

The sandwiched diameter in the vertical direction of all specified grains (for example, the Nd R1 grains) shown in this image are measured, and this measurement is used for the diameter of those particles. "Sandwiched diameter" means the so-called "Feret diameter", which shows the powder grain diameter. "Vertical direction" is a specific direction freely chosen from the observed image. When measuring each grain diameter in this same image, that measurement direction is kept unchanged. This measuring method was devised by the inventor, based on the Feret powder grain diameter.

A sharp distinction between the grains of Co-less R1 d-HDDR anisotropic magnet powder which has been split and become fine (hereafter, "coarse magnet powder"), and the grains of R2 fine magnet powder (hereafter, "fine magnet powder") can be made by analyzing their constituent elements R1 and R2. In particular, when the EPMA analysis image is color, a sharp distinction in those powder grains is easily performed with color-coding. When R1 and R2 are the same element, elements that can be distinguished by EPMA (Dy, Al etc.) are separately included in each powder without exerting a negative influence on the division of powder grains. Analysis of such included elements makes it is possible to draw a sharp distinction between the grains of Co-less R1 d-HDDR coarse magnet powder and the grains of R2 fine magnet powder.

From the outside grain diameter thus measured, we find a normalized grain count with per unit area apparent grain diameter 20 μm or less. That is, we find the number of grains with apparent diameter 20 μm or less according to the above mentioned apparent grain diameter measurement method, divide by the measurement area, and calculate a normalized grain count of the whole with per unit area apparent grain diameter 20 μm or less. That result is the sum of the Co-less R1 d-HDDR coarse magnet powder grain count and R2 fine magnet powder grain count, so it is necessary to normalize the ratio of Co-less R1 d-HDDR coarse magnet powder with R2 fine magnet powder removed to the grain count of the whole. So, the previously found grain count of the whole is divided by the existing ratio of the Co-less R1 d-HDDR coarse magnet powder, giving "normalized grain count with per unit area apparent grain diameter 20 μm or less". To explain this with a concrete example: if, with apparent diameter 20 μm or less, grain count of the whole is 1000 pieces/$mm^2$, and the existing ratio of coarse magnet powder to the entire magnet powder (fine magnet powder+coarse magnet powder) is 80%, the coarse magnet powder normalized grain count is 1000/0.8, i.e., 1250 pieces/$mm^2$.

The reason for the limitation in the present invention to instances where the apparent grain diameter is 20 μm or less is that when that grain diameter is 20 μm or less, the large specific surface area becomes easily oxidized, a principle cause of deterioration in irreversible loss rate. In general, the average grain diameter often indicates influence on heat resistance from grain diameter, but in the case of the present invention, grains made by splitting the Co-less R1 d-HDDR coarse magnet powder worsen the irreversible loss properties of the bonded magnet. The extent of those fine splits is difficult to indicate by the average grain diameter, and so the indicator used in the present invention was introduced. As one example, the relationship between normalized grain count where per unit area apparent grain diameter is 20 μm and irreversible loss rate is shown in FIG. 7. The Co-less R1 d-HDDR coarse magnet powder used here is NdFeB coarse magnet powder comprised of Nd: 12.7 at %, Dy: 0.2 at %, Ga: 0.2 at %, Nb: 0.2 at %, B: 6.3 at % and remainder Fe. The R2 fine magnet powder uses SmFeN fine magnet powder (made by Nichia Corporation). That SmFeN fine magnet powder has an average grain diameter of 3 μm, and a composition of Sm: 10 at %, Fe: 77 at %, N: 13 at %. The production method of the sample bonded magnet, except for compacting pressure, is the same as in the case of the first example embodiment. The compacting pressure, normalized grain count, and irreversible loss rate at 120° C. for each sample are shown in Chart 5. From the results in FIG. 7, it is clear that when normalized grain count of the NdFeB coarse magnet powder in the molded bonded magnet with per unit area apparent grain diameter 20 μm or less exceeds $1.2\times10^9$ pieces/$m^2$, irreversible loss rate drastically deteriorates.

The bonded magnet of the present invention has high relative density of 91-99%. The higher the relative density, the more vacant space (holes) in the bonded magnet will decrease, deterring oxygen intrusion into the bonded magnet, improving the heat resistance of the bonded magnet, and of course improving magnetic properties. Sufficient magnetic properties and heat resistance cannot be obtained with a relative density less than 91%, though it is more desirable if the lower limit of relative density is 93%. The upper limit of relative density has been set at 99% in the present invention because it is in fact difficult to produce a bonded magnet with relative density exceeding 99%.

In the present specification, for the sake of convenience, coarse Co-less R1 d-HDDR anisotropic magnet powder whose surface is coated with #1 surfactant is called "Co-less R1 d-HDDR coarse magnet powder", and fine R2 anisotropic magnet powder whose surface is coated with #2 surfactant is called "R2 fine magnet powder." Both powders may have differing grain diameters, or have the same composition. Both surfactants may be the same type or different types. The resin may be either thermoplastic resin or thermosetting resin. When using thermosetting resin, the resin may be heated above the hardening point for a short time period during the heat orientation process or heat molding process. Even if heated above the hardening point, thermosetting resin will not start to harden due to bridging. Rather, by heating above the hardening temperature from the outset of heat molding, a ferromagnetic buffer layer with excellent fluidity is quickly formed, making it possible to design a shortened production cycle-time.

When heating above the hardening point, the above mentioned ferromagnetic fluid layer becomes a ferromagnetic buffer layer in hardened state as the thermosetting resin begins to harden after progressing for the designated time. Where the resin is thermoplastic resin, once molded the ferromagnetic fluid layer also becomes a hardened layer due to subsequent cooling. Due to thermal history received by the resin, its softening point can fluctuate. For example, the softening point at the time of molding the compound, having mixed each powder and resin and then heat kneading, and the softening point at the time of forming the ferromagnetic fluid flayer during the heat orientation process or heat molding process, having heated the compound within the die, may sometimes differ. Accordingly, softening point in the present invention means the softening point of the resin in each process. Also, "resin" in the present invention is not limited to meaning merely the resin simple, but also includes additives such as curing agents, accelerators, plasticizers, or molding assistants as necessary.

(Composite Rare-Earth Anisotropic Bonded Magnet Compound)

When manufacturing the composite rare-earth anisotropic bonded magnet of the present invention, it is suitable to use, for example, the following type of compound from the present invention.

A composite rare-earth anisotropic bonded magnet compound of the present invention comprises:

(A) Cobalt-less R1 d-HDDR coarse magnet powder having an average grain size of 40-200 μm, comprising:
  1. Cobalt-less R1 d-HDDR anisotropic magnet powder, obtained by performing a d-HDDR treatment on a cobalt-less R1 alloy with R1, Fe, and B as the main ingredients and fundamentally not containing cobalt; and
  2. #1 surfactant that coats at least one part of the grain surface of said cobalt-less R1 d-HDDR anisotropic magnet powder; and (B) R2 fine magnetic powder with an average aspect ratio of 2 or less and average grain diameter 1-10 μm, comprising:
  1. R2 anisotropic magnet powder with a maximum energy product (BH)max of 240 kJ/$m^3$ or more and with R2 as one of the main ingredients; and
  2. #2 surfactant that coats at least one part of the grain surface of said R2 anisotropic magnet powder; and (C) a resin as binder.

The compound contains 50-84 wt % of said Co-less R1 d-HDDR coarse magnet powder, 15-40 wt % of said R2 fine magnet powder, and 1-10 wt % of said resin.

This compound has a composition that direct contact between grains of the Co-less R1 d-HDDR coarse magnet powder is avoided by enveloping the grains in a ferromagnetic buffer in which R2 fine magnet powder uniformly disperses in the said resin.

(Production Method for Composite Rare-Earth Anisotropic Bonded Magnet Compound)

The above-mentioned compound, for example, is obtained by the following production method of the present invention.

A production method for the composite rare-earth anisotropic bonded magnet compound of the present invention comprises:

(1) A mixing process which combines and mixes:

(A) Cobalt-less R1 d-HDDR coarse magnet powder having an average grain size of 40-200 μm, comprising:
  1. Cobalt-less R1 d-HDDR anisotropic magnet powder, obtained by performing a d-HDDR treatment on a cobalt-less R1 alloy with R1, Fe, and B as the main ingredients and fundamentally not containing cobalt; and
  2. #1 surfactant that coats at least one part of the grain surface of cobalt-less R1 d-HDDR anisotropic magnet powder; and (B) R2 fine magnetic powder with an average aspect ratio of 2 or less and average grain diameter 1-10 μm, comprising:
  1. R2 anisotropic magnet powder with a maximum energy product (BH)max of 240 kJ/$m^3$ or more and with R2 as one of the main ingredients; and
  2. #2 surfactant that coats at least one part of the grain surface of R2 anisotropic magnet powder; and (C) a resin as binder; wherein the ingredients are mixed in a ratio of 50-84 wt % of Co-less R1 d-HDDR coarse magnet powder, 15-40 wt % of R2 fine magnet powder, and 1-10 wt % of resin; and (2) a heat kneading process in which after the mixing process, the mixture is heated to a temperature above the softening point of the resin, and then kneaded.

This production method obtained a compound in which direct contact between grains of the said Co-less R1 d-HDDR coarse magnet powder is avoided by enveloping the grains in a ferromagnetic buffer in which the R2 fine magnet powder is uniformly dispersed in the resin.

In the compound of the present invention, each grain of the Co-less R1 d-HDDR coarse magnet powder is enveloped by the ferromagnetic buffer resin in which nearly spherical-shaped R2 fine magnet powder is nearly evenly dispersed, preventing those grains from directly touching each other. When molding the bonded magnet which uses this compound within a heated magnetic field, the ferromagnetic buffer softens or melts during molding, and the above-mentioned ferromagnetic fluid layer appears. As a result, the Co-less R1 d-HDDR coarse magnet powder can easily shift position, along with avoiding stress concentration on the constituent grains. With few fractures in the constituent grains and high density, a bonded magnet is obtained that has outstanding magnetic properties and heat resistance.

The excellent results exhibited by the compound of the present invention are due to the grains of Co-less R1 d-HDDR coarse magnet powder being enveloped by the ferromagnetic buffer resin in which R2 fine magnet powder is evenly dispersed. By forming a ferromagnetic buffer that has such even dispersal, it is extremely effective to head knead the Co-less d-HDDR coarse magnet powder, R2 fine magnet powder, and resin, rather than simply kneading at room temperature. Further, when using thermosetting resin as a binder, the temperature during heat kneading (heat kneading temperature) should be above the softening point of the resin in that stage, and below the hardening point. When using a compound produced by heat kneading at a temperature above the hardening point, fractures will more easily occur in the obtained bonded magnet.

When producing the bonded magnet of the present invention, each process may be conducted consecutively, and each process may be conducted in several stages, carefully considering such things as productivity, dimensional accuracy, and consistent quality. For example, the heat orientation process and subsequent heat molding process may be performed consecutively in one molding die (one step molding), or in a different molding die (two step molding). Pressurizing may be performed during the heat orientation process. Further, the process of weighing the compound used as material for the bonded magnet may be performed with a separate die (three step molding). In that case, the heat orientation process is at least a process of heating and magnetic field orienting the green compact in which the compound is press molded. By carrying out the molding of the bonded magnet in several stages, it becomes easier to design improvements in productivity, and equipment operation rate can also be increased.

BRIEF DESCRIPTION OF THE DRAWINGS

FIG. 1A: A figure that schematically shows the composite rare-earth anisotropic bonded magnet compound involved in the present invention.

FIG. 1B: A figure that schematically shows a conventional bonded magnet compound.

FIG. 2A: A figure that schematically shows the composite rare-earth anisotropic bonded magnet involved in the present invention.

FIG. 2B: A figure that schematically shows a conventional bonded magnet compound.

DESCRIPTION OF THE PREFERRED EMBODIMENTS

Figure 3:
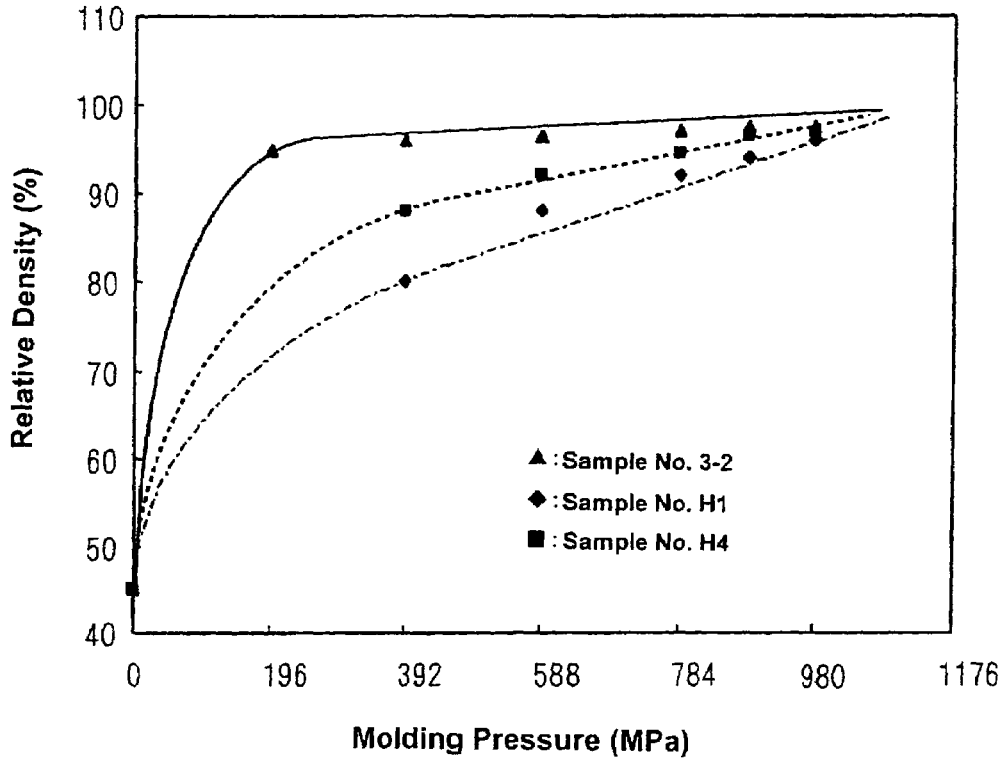
FIG. 3: A graph that shows the relationship between molding pressure and relative density.

Example embodiments and a more detailed explanation of the present invention will now be given. It is clear that the contents of the explanation in the present specification, including the example embodiments below, fittingly correspond to the composite rare-earth anisotropic bonded magnet, composite rare-earth anisotropic bonded magnet compound, and methods for their production having to do with the present invention. The objects of this invention are permitted to differ from the examples herein, depending on the required properties, regardless of whether or not the embodiments are ideal.

(1) Co-Less R1 d-HDDR Coarse Magnet Powder

Co-less R1 d-HDDR coarse magnet powder is comprised of Co-less R1 d-HDDR anisotropic magnet powder and a #1 surfactant that coats that powder's grain surface. For the Co-less R1 d-HDDR coarse magnet powder prior to press molding the bonded magnet, it is OK to assume that the entire face of the Co-less R2 d-HDDR anisotropic magnet powder is about evenly coated by the #1 surfactant. Naturally, when there are micro-cracks on the surface of the Co-less R2 d-HDDR anisotropic magnet powder from the d-HDDR treatment, those cracks are not always completely covered by the #1 surfactant, but in the present invention, being coated by #1 surfactant also includes such incomplete coverage. This is because the "ferromagnetic liquid layer" of the present invention which appears during the molding of the bonded magnet will fully serve its function even if the surfactant does not penetrate all the way to the inside of those cracks.

On the other hand, in the case of the Co-less R1 d-HDDR coarse magnet powder after press molding the bonded magnet, the application of compacting pressure causes fractures to occur in part of the grains. The fracture surface of those fractured grains is naturally not coated by the #1 surfactant. So, in the bonded magnet of the present invention, "at least one part" of the Co-less R1 d-HDDR coarse magnet powder is coated by #1 surfactant. This condition is the same for the R2 fine magnet powder mentioned later.

Co-less R1 d-HDDR anisotropic magnet powder is magnet powder obtained by applying a d-HDDR treatment to an R1FeB alloy having R1, Fe, and Bas the main ingredients. This d-HDDR treatment is published in the previously mentioned "Dictionary of Electronic Components", and also reported in detail in public domain literature (Mishima et al: Journal of the Magnetics Society of Japan, 24(2000), p. 407). The d-HDDR treatment is performed by controlling the speed of reaction between an R1FeB alloy and hydrogen from room temperature to high temperature.

In detail, the four principal production stages are the low-temperature hydrogenation stage (stage 1) where hydrogen is sufficiently absorbed into the R1FeB alloy at room temperature, the high-temperature hydrogenation stage (stage 2) where the 3-phase decomposition (disproportionation) reaction occurs under low hydrogen pressure, the evacuation stage (stage 3) where hydrogen is decomposed under as high a hydrogen pressure as possible, and the desorption stage (stage 4) where the hydrogen is extracted. The d-HDDR process differs from the conventional HDDR process in that with the d-HDDR process, through the preparation of multiple production stages with different temperatures and hydrogen pressures, the reaction rate of the R1FeB alloy and hydrogen can be kept relatively slow, and homogeneous anisotropic magnet powder is obtained.

More specifically, the low-temperature hydrogenation step, for example, maintains a hydrogen gas atmosphere with hydrogen pressure 30-200 kPa at 600° C. or less. The high-temperature hydrogenation step maintains a hydrogen gas atmosphere with hydrogen pressure 20-100 kPa at 750-900° C. The evacuation step maintains a hydrogen gas atmosphere with hydrogen pressure 0.1-20 kPa at 750-900° C. The desorption step maintains a hydrogen gas atmosphere with hydrogen pressure 10-1 Pa or less. Unless specifically mentioned otherwise, "hydrogen pressure" in the present specification means the partial pressure of hydrogen. Accordingly, as long as the hydrogen pressure during each process is within the prescribed value, either a vacuum atmosphere or a mixed atmosphere with inert gas are both acceptable. Using this d-HDDR method, R1FeB anisotropic magnet powder with high magnetic properties can be mass produced at an industrial level without the need to use Co, which is an expensive scarce natural resource and difficult to obtain.

The average grain diameter of Co-less R1 d-HDDR coarse magnet powder before bonded magnet molding is 40-200 μm. This is because at less than 40 μm the maximum energy product (BH)max deteriorates, and when exceeding 200 μm residual magnetic flux density (Br) deteriorates. It is more desirable for the average grain diameter to be 74-150 μm. Incidentally, when taking into account fractures generated during the heat molding process, the average grain diameter of Co-less R1 d-HDDR coarse magnet powder after bonded magnet molding is smaller than the above-mentioned average grain diameter before bonded magnet molding. However, when those fractures are generated, they are far smaller in the case of the present invention than with the conventional technology. Therefore, as long as the Co-less R1 d-HDDR coarse magnet powder in the bonded magnet after molding has a normalized grain count within the range of $1.2\times10^9$ pieces/$m^2$ or less with per unit area apparent grain diameter 20 μm or less, the obtained bonded magnet exhibits outstanding magnetic properties and heat resistance.

In the present invention, the mixture ratio of Co-less R1 d-HDDR coarse magnet powder is 50-84 wt %. This is because at less than 50 wt % maximum energy product (BH)max deteriorates, and when exceeding 84 wt % there is relatively little ferromagnetic buffer layer, and the effect of suppressing irreversible loss will fade. It is more desirable if this mixture ratio is 70-80 wt %. Weight percent (wt %) in the present specification means the ratio when the whole of the bonded magnet or the whole of the compound is 100 wt % (same below).

As an example, the composition of Co-less R1 d-HDDR anisotropic magnet powder has 11-16 at % R1, 5.5-15 at % B, and Fe as the main ingredients, and naturally, unavoidable impurities. $R1_2Fe_{14}B$ in main phase is representative. In this case, with less than 11 at % R1, α-Fe phase precipitates and magnetic properties deteriorate, and when exceeding 16 at % $R1_2Fe_{14}B$ phase decreases and magnetic properties deteriorate. And, with 5.5 at % or less of B, soft magnetism $R1_2Fe_{17}$ phase precipitates and magnetic properties decrease, and when exceeding 15 at % the volume fraction of the B-rich phase in the magnet powder increases, $R1_2Fe_{14}B$ phase decreases and magnetic properties deteriorate, so it is undesirable.

This R1 is comprised of scandium (Sc), yttrium (Y) and lanthanoid. For that matter, for an element with exceptional magnetic properties, it is best to be comprised of one or more of lanthanum (La), cerium (Ce), praseodymium (Pr), neodymium (Nd), samarium (Sm), gadolinium (Gd), terbium (Tb), dysprosium (Dy), holmium (Ho), erbium (Er), thulium (Tm) and lutetium (Lu). This point is the same with respect to the R2 mentioned later. Particularly from the perspective of cost and magnetic properties, it is preferable if R1 is comprised mainly of one or more of Nd, Pr, and Dy.

Further, in the Co-less R1 d-HDDR anisotropic magnet powder having to do with the present invention, separate from the above-mentioned R1, it is desirable to include at least one or more of the rare earth elements (R3) Dy, Tb, Nd, and Pr. Specifically, taking the whole of each magnet powder as 100 at %, it is desirable to include 0.05-5.0 at % R3. These elements raise the initial coercive force of the Co-less R1 d-HDDR anisotropic magnet powder, and also exhibit an effect on controlling aging loss in the bonded magnet. When there is less than 0.05 at % R3, there is little increase in initial coercive force, and when exceeding 5 at % a deterioration in (BH)max occurs. It is most desirable to have 0.1 to 3.0 at % of R3.

In the Co-less R1 d-HDDR anisotropic magnet powder of the present invention, separate from the above-mentioned R1, it is desirable to include La. Doing so will control the aging loss of the magnet powder and the bonded magnet. La has an effect on control of aging loss because it is the element with the greatest oxidation electrical potential among the rare-earth (R.E.) elements. Therefore, using La as a so-called 'oxygen-getter', La is oxidized prior to the above-mentioned R1 (Nd, Dy, etc.), and as a result oxidation of the magnet powder and bonded magnet including La is controlled.

La exhibits an improving effect on heat resistance when included in small quantities that exceed the level of unavoidable impurities. The level of La unavoidable impurities is less than 0.001 at %, so in the present invention, the amount of La used is 0.001 at % or more. On the other hand, when La exceeds 1.5 at %, it invites an undesirable decrease in iHc. So, when the lower limit of the amount of La is 0.01 at %, 0.05 at %, or 0.1 at %, an ample improving effect on heat resistance is exhibited, which is desirable. From the standpoint of improving heat resistance and controlling iHc deterioration, it is more desirable for the quantity of La to be 0.01-1.0 at %.

When there is 10.8-15 at % B in the Co-less R1 d-HDDR anisotropic magnet powder, the composition of the magnet powder including La is not an alloy composition in which the $R1_2Fe_{14}B_1$ phase exists as either a single phase or nearly single phase, but an alloy composition made from a multiphase composition of $R1_2Fe_{14}B_1$ phase and B-rich phase.

In the Co-less R1 d-HDDR anisotropic magnet powder, various elements other than R1, B and F that improve the magnetic properties may be included. For example, it is good to include either or both of 0.01-1.0 at % gallium (Ga) and 0.01-0.6 at % niobium (Nb). By including Ga, the coercive force of Co-less R1 d-HDDR anisotropic magnet powder improves. When the amount of Ga included is less than 0.01 at %, the effect of improving coercive force is not obtained, and when exceeding 1.0 at % coercive force decreases. By including Nb, the reaction rate of phase transformation and opposite phase transformation during the hydrogenation treatment can be easily controlled. When the amount of Nb included is less than 0.01 at %, it is difficult to control the reaction rate, and when the amount of Nb exceeds 0.6 at % the coercive force is diminished. In particular, when Ga and Nb within the above-mentioned limits are included together, coercive force and anisotropy can both be improved in comparison to including only the simple substance, and (BH) max is improved as a result. It is desirable to include in sum total 0.001-5.0 at % of one, two or more elements from among aluminum (Al), silicon (Si), titanium (Ti), vanadium (V), chromium (Cr), manganese (Mn), nickel (Ni), copper (Cu), germanium (Ge), zirconium (Zr), molybdenum (Mo), indium (In), tin (Sn), hafnium (Hf), tantalum (Ta), tungsten (W), and lead (Pb). By including these elements, it is possible to improve the squareness ratio and coercive force of the obtained magnet. When the amount included is less than 0.001 at % the effect of improving magnetic properties does not manifest, and when exceeding 5.0 at %, the precipitation phase precipitates and coercive force declines.

In the present invention, Co-less R1 d-HDDR anisotropic magnet powder manifests anisotropy without including Co, and the bonded magnet made from that magnet powder exhibits ample magnetic properties. Thus, in the present specification the expression "co-less" is used, meaning that it is not necessary to treat Co as a required element. However, Co itself is an element that will increase the Curie temperature of the magnet powder, and improve temperature properties. That is, Co is an element that will further increase the magnetic properties and heat resistance of the Co-less R1 d-HDDR anisotropic magnet powder. Accordingly, even for the magnet powder of the present invention, it is not necessary to deny the inclusion of Co. Therefore the Co-less R1 d-HDDR anisotropic magnet powder of the present invention may contain 0.001-6 at % Co. If the amount of included Co is less than 0.001 at % those beneficial effects will not be seen, and exceeding 6 at % will invite a decrease in magnetic properties in addition to the high price of raw materials.

The method of preparing the ingredient alloy of Co-less R1 d-HDDR anisotropic magnet powder is not particularly restricted. Generally, it is good to mix high purity alloy ingredients in the prescribed composition, melt with a high frequency melting method, then cast and make alloy ingots. Naturally, the coarse magnet powder made from these pulverized ingots may be used as the raw ingredient alloy. It is likewise fine to perform homogenization treatment, and then take as the raw ingredient alloy an alloy in which distortions in the composition distribution have been diminished. Powderizing during ingot pulverization and the above-mentioned hydrogenation treatment can be performed using either wet or dry machine pulverizing (jaw crusher, disc mill, ball mill, vibrating mill, jet mill, etc.). It is effective to also include the earlier-stated Dy, Tb, Nd or Pr(R3), La, Ga, Nb, Co, etc. alloy elements in the raw materials alloy during the above-mentioned preparation.

As stated above, because R3 and La are elements that improve the heat resistance of Co-less R1 d-HDDR anisotropic magnet powder, it is desirable for R3 and La to exist on the surface or in the near vicinity of the constituent grains of magnet powder. Accordingly, rather than including R3 and La in the raw ingredient alloy from the beginning, by mixing the R3 powder and La powder into the Co-less R1 d-HDDR anisotropic magnet powder during or following production of the magnet powder, and dispersing the R3 and La inside or on the surface of those powder grains, magnet powder with more outstanding heat resistance is obtained. The Co-less R1 d-HDDR anisotropic magnet powder of the present invention also includes magnet powder obtained with this kind of production method.

That R3 magnet powder should include the above-mentioned R3, comprised of at least, for example, one or more of R3 simple, R3 alloy, R3 compound or each of those materials in hydrogenated form. The La magnet powder should similarly include La comprised of at least, for example, one or more of La simple, La alloy, La compound, or each of those materials in hydrogenated form. For the R3 alloy and La alloy, it is desirable if, carefully considering the influence on magnetic properties, they are made from an alloy of transition-metal element (TM) and La, compound (including intermetallic compound), or those materials in hydrogenated form. To give some concrete examples, there are LaCo(Hx), LaNdCo(Hx), LaDyCo(Hx), R3Co(Hx), R3NdCo(Hx), R3DyCo(Hx), etc. Only Co is mentioned here as a transition-metal, but Fe may also be used. The same is true for R3 magnet powder. When those magnet powders are made from an alloy or compound (including hydrogenated material), it is most suitable for the R3 and La included in those alloys to be 20 at % or more, or 60 at % or more.

The dispersion of R3 and La on the surface of or within the magnet powder, can, for example, be performed by dispersion heat treatment processing of the mixed magnet powder, in which R3 powder and La powder are mixed into Co-less R1 d-HDDR anisotropic magnet powder at a temperature of 673-1123K. This dispersion heat treatment process may be performed after mixing of the R3 powder and La powder, or at the same time as the mixing. When the treatment temperature is less than 673K, it is difficult for the R3 powder and La powder to change to liquid phase, and ample dispersion treatment is a problem. On the other hand, when the temperature exceeds 1123K, crystal grain growth in the Co-less R1 d-HDDR anisotropic magnet powder is produced, inviting a deterioration in iHc, and heat resistance (irreversible loss rate) can not be sufficiently improved. It is desirable for the time of the treatment to be 0.5-5 hours. At less than 0.5 hours the dispersion of R3 powder and La powder is insufficient, and heat resistance of the magnet powder does not see much improvement. On the other hand, exceeding 5 hours will invite a deterioration in iHc. This dispersion heat treatment process should be performed in an oxidation-inhibited atmosphere (for example, a vacuum atmosphere). When this dispersion heat treatment process is merged with the no. 1 evacuation stage or no. 2 evacuation stage of the d-HDDR treatment, the treatment temperature, treatment time, and treatment atmosphere should be adjusted within limits common to both the d-HDDR treatment and dispersion heat treatment process.

When performing these treatments, the shape (grain diameter, etc.) of the Co-less R1 d-HDDR anisotropic magnet powder, R3 magnet powder and La magnet powder does not matter, but from the standpoint of efficiently proceeding with the dispersion heat treatment process, it is most suitable if the Co-less R1 d-HDDR anisotropic magnet powder has an average grain diameter 1 mm or less, and the R3 powder and La powder have average grain diameters 25 mm or less. Also, this Co-less R1 d-HDDR anisotropic magnet powder, depending on the suitable progression of hydrogenation treatment, may be hydrogenated material, magnet powder, material with three-phase analyzed composition, or any of those materials in re-crystallized form.

When adding R3 or La during the production of Co-less R1 d-HDDR anisotropic magnet powder, the companion ingredient Co-less R1 d-HDDR anisotropic magnet powder has to a greater or lesser extent changed to a hydrogenated state (hereafter, this magnet powder of hydrogenated material is called "R1FeBHx powder"). The reason being, R3 and La are added after the hydrogenation stage, either before the de-hydrogenation stage is complete or after the high temperature hydrogenation stage, before the No. 2 evacuation stage is complete. This R1FeBhx magnet powder is in a state in which, in comparison to a state not including oxygen, R1 and Fe are unusually difficult to oxidize. Therefore, it is possible to perform the dispersion and coating of R3 and La in a state in which oxidation is controlled, and a bonded magnet with excellent heat resistance is consistently obtained. For the same reason, it is desirable for R3 powder and La powder to be material in a hydrogenated state. For example, R3CoHx and LaCoHx are good. To obtain the bonded magnet with excellent magnetic properties of the present invention, it is desirable for the Co-less R1 d-HDDR anisotropic magnet powder to be 279.3 kJ/$m^3$ or greater, or 344 kJ/$m^3$ or greater.

The matters stated above apply similarly with respect to R2 anisotropic magnet powder (particularly the case of Co-less R2 d-HDDR anisotropic magnet powder). For the Co-less R1 d-HDDR anisotropic magnet powder and R2 anisotropic magnet powder, R1 and R2 may be the same, and further it is fine for both magnet powders to have the same composition.

(2) R2 Fine Magnet Powder

R2 fine magnet powder is comprised of R2 anisotropic magnet powder and #2 surfactant that coats the surface of those grains. Naturally, the grain diameter is smaller than that of Co-less R1 d-HDDR coarse magnet powder. That average diameter is the grain diameter including the surfactant. In the case of the present invention, although the R2 anisotropic magnet powder that will be the base of the R2 fine magnet powder has prescribed magnetic properties ((BH)max) and shape (aspect ratio)), the composition and production method do not matter. Representative are R2 d-HDDR anisotropic magnet powder and SmFeN anisotropic magnet powder with main phase $SmFe_{17}N$. Just as in the case of Co-less R1 d-HDDR anisotropic magnet powder, various elements may also be included besides the main ingredients, such as Co to increase magnetic properties.

The above-cited SmFeN anisotropic bonded magnet, for example, is produced in the following manner. An Sm—Fe alloy of the desired composition receives solution treatment, and is then pulverized in nitrogen gas. After pulverization, the alloy receives nitride treatment in a $NH_3$+$H_2$ gas mixture and is then cooled. When pulverized by jet mill, 10 μm or less fine SmFeN anisotropic magnet powder is obtained. High coercive force is obtained by making the grain diameter of this SmFeN anisotropic magnet powder the simple magnetic domain grain size.

In the present invention, the average grain diameter of R2 fine magnet powder is 1-10 μm. When this grain diameter is less than 1 μm, the powder is easily oxidized, residual magnetic flux density (Br) decreases and there is a loss in maximum energy product (BH)max. When this grain diameter exceeds 10 μm, coercive force decreases. When R2 fine magnet powder grain diameter is larger, there is an undesirable decline in the relative density (filling factor) of the bonded magnet, and in the fluidity of the ferromagnetic fluid layer during magnet molding. The average grain diameter of this R2 fine magnet powder coincides with the average grain diameter of the above-mentioned SmFeN anisotropic magnet powder. It is more desirable for the average grain diameter of R2 anisotropic magnet powder to be 1-5 μm.

In the present invention, the range of the average grain diameter of R2 fine magnet powder does not change before and after bonded magnet molding. This is because along with the R2 fine magnet powder being considerably fine in relation to the Co-less R1 d-HDDR coarse magnet powder, and nearly spherical-shaped, during heat molding of the bonded magnet the R2 fine magnet powder is floating in an abundantly fluid resin, so that there is almost no change in grain diameter from fractures caused by stress concentration. The average grain diameter of R2 fine magnet powder is the diameter after being coated with surfactant. However, because that coating layer is unusually thin, there is normally not a large difference between this average grain diameter and the average grain diameter of the magnet powder alone.

In the present invention the mixture ratio of R2 fine magnet powder is 15-40 wt %. When less than 15 wt %, the space between constituent grains of Co-less R1 d-HDDR anisotropic magnet powder is not sufficiently filled, and stress concentration on the Co-less R1 d-HDDR coarse magnet powder during the heat molding process is not sufficiently avoided. On the other hand, when exceeding 40 wt %, Co-less R1 d-HDDR anisotropic magnet powder becomes relatively less of the mixture, and magnetic properties of the bonded magnet decrease.

(3) Surfactant and Resin

Surfactant is used in order to increase fluidity in the resin of the Co-less R1 d-HDDR anisotropic magnet powder and R2 anisotropic magnet powder when heat molding the bonded magnet. By doing so, high levels of lubrication, filling, and orientation are manifested at the time of heat molding, and a bonded magnet with excellent magnetic properties and heat resistance is obtained.

For example, focusing on Co-less R1 d-HDDR coarse magnet powder with large grain diameter, at the time of the above-mentioned heat molding, due to the presence of #1 surfactant which coats the grain surface, the Co-less R1 d-HDDR coarse magnet powder can be thought to exist in a state in which it floats in a sea of the ferromagnetic fluid layer. As a result, even when applying molding pressure to Co-less R1 d-HDDR anisotropic magnet powder, which is highly susceptible to fractures, those constituent grains easily rotate and change position, greatly alleviating stress concentration and preventing the advancement of microcracks. Also, due to the presence of surfactant, the bonding of binder resin and R2 anisotropic magnet powder is strengthened, and during magnetic field heat molding both become one body, more easily forming a pseudo-fluid layer (ferromagnetic fluid layer).

The type of surfactant is not particularly limited, but is decided after carefully considering the type of binder resin. For example, if employing epoxy resin, it possible to use either a titanate coupling agent or silane coupling agent. Apart from these, if employing phenol resin, a silane coupling agent can be used as a combination of resin and surfactant.

Co-less R1 d-HDDR coarse magnet powder, for example, is obtained from the #1 coating process, in which Co-less R1 d-HDDR anisotropic magnet powder and the solution of above-mentioned #1 surfactant are stirred and then dried. Similarly, R2 fine magnet powder, for example, is obtained from the #2 coating process, in which R2 fine magnet powder and the solution of above-mentioned #2 surfactant are stirred and then dried. When performing the above-mentioned #1 coating process and #2 coating process at the same time, using the common surfactant of the mixed Co-less R1 d-HDDR anisotropic magnet powder and R2 anisotropic magnet powder, there is a good improvement in production efficiency. The film thickness of the surfactant coating layer is 0.5-2 μm. As for the condition of the raw materials (compound), even assuming that each face of the constituent grains is coated by surfactant, it is possible that only one part of the grain face of Co-less R1 d-HDDR anisotropic magnet powder present in the bonded magnet is coated by the surfactant. This is because if one part of the Co-less R1 d-HDDR anisotropic magnet powder fractures during molding, a new fracture face is generated.

The binder resin used in the present invention is not limited to heat-hardened resin; thermo-plastic resin may also be used. For heat-hardened resins there are, for example, the above-mentioned epoxy resins and phenol resins; and for thermo-plastic resins there are, for example, nylon 12 and polyphenolene sulfides.

The resin compounding ratio, which is 1-10 wt % in the present invention, lacks binding power at less than 1 wt %, and when surpassing 10 wt % the (BH)max magnetic properties deteriorate.

(4) Bonded Magnet and Compound

The compound of the present invention, for example, is obtained by mixing and then heat kneading the mixture of Co-less R1 d-HDDR coarse magnet powder, R2 fine magnet powder and resin. The resulting compound has a granular shape with average grain diameter 50-500 μm. As one example, the appearance of the compound is schematically shown in FIG. 1A. This figure is schematically transcribed based upon an EPMA photograph taken by SEM observation of a compound made from Co-less NdFeB d-HDDR coarse magnet powder and SmFeN fine magnet powder. FIG. 1B schematically shows the appearance of a conventional compound made from NdFeB d-HDDR anisotropic magnet powder and resin. As understood from FIG. 1B, in the conventional compound, resin simply adheres to the grain face of NdFeB d-HDDR anisotropic magnet powder. Whereas, in the case of the compound of the present invention, as shown in FIG. 1A, the NdFeB coarse magnet powder is enveloped by a ferromagnetic buffer in which the SmFeN fine magnet powder is evenly dispersed in resin.

NdFeB coarse magnet powder is suitable for Co-less R1 d-HDDR coarse magnet powder, and SmFeN fine magnet powder is suitable for R2 fine magnet powder. FIG. 1A shows a state in which each grain of NdFeB coarse magnet powder is separated, but the compound of the present invention is not limited to such a condition. That is, in the compound of the present invention, a plural number of the constituent grains may be bound together, and also material with each grain separated and material with a plural number of grains bound together may be intermingled.

Next, FIG. 1A, B and similarly FIG. 2A, B schematically show one expanded part of the bonded magnet obtained by heated magnetic field molding. FIG. 2A shows the bonded magnet of the present invention, and FIG. 2B shows a conventional bonded magnet. As is clear from FIG. 2B, in the case of the conventional bonded magnet, due to press molding, the grains of NdFeB coarse magnet powder directly contact each other, and stress concentration occurs in the affected parts. Because NdFeB d-HDDR anisotropic magnet powder has a high susceptibility to fractures due to micro-cracks located on the surface by the d-HDDR treatment, fractures are easily caused by the above-mentioned stress concentration. Newly formed active fracture surfaces are oxidized, which causes magnetic properties to deteriorate.

On the other hand, in the case of the example of the bonded magnet of the present invention shown in FIG. 2A, the surface of each grain of NdFeB coarse magnet powder is evenly enveloped by a ferromagnetic buffer made of epoxy resin in which SmFeN fine magnet powder is dispersed. To put it another way, epoxy resin exists between the SmFeN fine magnet powder and NdFeB coarse magnet powder, and at the same time, SmFeN fine magnet powder is evenly distributed around the NdFeB coarse magnet powder.

The "ferromagnetic fluid layer" formed in this case, as previously defined, has an organization wherein SmFeN fine magnet powder is uniformly distributed in a softened or melted coating resin, which soaks the grain surface of NdFeB coarse magnet powder coated by surfactant. When this ferromagnetic fluid layer appears due to heating, a state is created in which as the resin softens or melts and spreads out, the SmFeN fine magnet powder soaks into that resin through the surfactant. Therefore, the fluidity of SmFeN coarse magnet powder increases with heating. If the SmFeN fine magnet powder is not evenly dispersed in the resin, but condensed and unevenly distributed, the fluidity (mobility) of SmFeN fine magnet powder will decline because the SmFeN fine magnet powder has not been amply surrounded by resin. Accordingly, the more evenly the SmFeN fine magnet powder is dispersed in the resin, the more the fluidity of what is called the "ferromagnetic fluid layer" in the present invention will increase. When the SmFeN is very evenly dispersed, grains of NdFeB coarse magnet powder directly contact each other only through the resin during heat molding of the bonded magnet, increasing the control of fractures in the NdFeB coarse magnet powder provided by the ferromagnetic fluid layer and above-mentioned fluidity.

Moreover, due to this even dispersion, the filing factor (relative density) increases at an early stage because during heat molding, grain gaps in the NdFeB coarse magnet powder are easily filled up by SmFeN fine magnet powder wrapped in resin. Consequently, by increasing that even dispersion, an unusually high filling factor is obtained even with ordinary molding pressure. It is desirable for this even dispersion of SmFeN fine magnet powder in the resin to exist from the compound stage, as it is not easily obtained by merely heating the simple mixture.

The functions provided by the ferromagnetic fluid layer will be explained in more detail, dividing into the above-mentioned "fluidity" and "easy filling". When performing the magnetic field heat molding of the bonded magnet, the NdFeB coarse magnet powder is just as if floating in the ferromagnetic fluid layer, (in a state prior to hardening or solidifying) in which SmFeN fine magnet powder is evenly dispersed in resin. Therefore, during magnetic field heat molding, with the grains of NdFeB coarse magnet powder obtaining a large degree of positional freedom, the ferromagnetic fluid layer plays the role of a so-called 'cushion', direct contact between each constituent grain of NdFeB coarse magnet powder is avoided, and local outbreak of stress concentration is deterred. This function of the ferromagnetic fluid layer is called "fluidity" in the present specification. "Easy filling" means that due to even dispersion of the ferromagnetic fluid layer, even when the bonded magnet is molded with low molding pressure, density can be readily increased. Both of these properties together are functions provided by the ferromagnetic fluid layer, and can not be strictly divided. They will be explained below with concrete examples.

Fluidity and easy filling are indicated, for example, by variables such as relative density of the bonded magnet formed under optional molding pressure, viscosity coefficient during heating of the compound used, and shearing torque during bonded magnet molding. However, in the present specification, relative density is an indication of fluidity and easy filling. The reason is that by using a measured prototype (bonded magnet) just as it is, irreversible loss rate, which is the objective, can be measured. Relative density is the ratio ($\rho/\rho_{th}$) of the density of the molded body ($\rho$) to the theoretical density ($\rho_{th}$) determined from the mixture ratio of raw ingredients.

FIG. 3 shows the actual results of researching the relationship between molding pressure and the relative density of molded bodies molded under various molding pressures. In the same figure, ▲ shows the relative density for various changes in molding pressure for sample No. 3-2 of the third example embodiment. Similarly, ♦ is the relative density with respect to sample No. H1 in the second comparison example mentioned later, and ■ is the relative density with respect to sample No. H4.

Sample No. 3-2 (▲) is the case of using a heat kneaded compound of NdFeB coarse magnet powder on which surfactant has been conferred, SmFeN fine magnet powder, and resin, and magnetic field heat molding of the bonded magnet. In this case, the relative density increases suddenly from a low grade of molding pressure, and at a molding pressure level of 198 MPa (2 ton/cm$^2$), relative density virtually reaches saturation. Therefore, it is possible to mold a bonded magnet having the desired properties with an unusually low molding pressure. This indicates the manifestation of outstanding fluidity and filling. In other words, during magnetic field heat molding the ferromagnetic layer exhibits unusually excellent fluidity, NdFeB coarse magnet powder can easily change position and stress concentration on the constituent grains is avoided, making it possible to easily attain a high filling factor.

Additionally, as the amount of oxygen included is decreased by improvement in filling factor, external causes of oxidation are cut off, and by doing so a bonded magnet with unusually excellent heat resistance (irreversible loss rate) is obtained. With the ferromagnetic fluid layer formed, high filling factor and high fracture control of the NdFeB coarse magnet powder are seen as a result of the excellent fluidity and filling of the ferromagnetic fluid layer, even when molding at an ordinary molding pressure of 882 MPa. The obtained bonded magnet has unusually high magnetic properties with (BH)max of 180.0 kJ/m$^3$, and moreover, small normalized grain count at $0.8\times10^9$/m$^2$ and good irreversible loss rate at −3.7%.

In Sample No. H4 (■), each magnetic powder and the resin were kneaded at room temperature and then magnetic field heat molding was performed. In this case, build up of relative density from molding pressure is sluggish, and high fluidity and good filling like that in sample No. 3-2 (▲) are not obtained. Without performing heat kneading, increase in relative density is slow, fluidity is poor, Co-less R1 d-HDDR coarse magnet powder can not easily change position, and both lubrication and cushioning are poor. Thus, irreversible loss rate is worse than that of heat kneaded material. There is not a large deterioration in aging loss, because restrictions set on criteria such as the coating of both magnet powders with surfactant, size of both magnet powders, and mixing ratio make it difficult for fractures to occur. In this case, it is not possible to obtain a bonded magnet compatible with both high magnetic properties and heat resistance (irreversible loss rate) at an ordinary molding pressure of 882 MPa.

And so, material on which heat kneading is not performed obtains the same level of relative density as heat kneaded material. The samples investigate whether or not, apart from considerations of productivity, even when not performing heat kneading, material is obtained that simultaneously satisfies the sort of high filling factor and fracture control of the present invention, when adding high molding pressure of the sort that is ordinarily not possible. For comparison example H7 in Chart 4, molding pressure of 1960 MPa was added, more than twice as much molding pressure as in example embodiment 3-1, and other than the point of not heat kneading, executed under the same conditions as example embodiment 3-1. As a result, when relative density is the same, normalized grain count of $1.5\times10^9$ pieces/m$^2$ greatly exceeds $1.2\times10^9$ pieces/m$^2$, and irreversible loss rate also decreases drastically.

The above results make clear that in production methods other than that of the present invention, formation of the ferromagnetic fluid flayer is difficult, making it hard to obtain high fluidity and good filling during molding, and because high filling factor and fracture control can not be obtained, it is also difficult for other production methods to be compatible with both high (BH)max values and excellent irreversible loss properties.

In sample No. H1 (♦), material was kneaded at room temperature and then formed at room temperature within a magnetic field. In this case, build up of relative density from molding pressure is even more sluggish, and high fluidity and good filling can not be obtained. Further, as is clear from Chart 4, magnetic properties and heat resistance (irreversible loss rate) are quite poor compared to other bonded magnets.

It is thought that a bonded magnet which provides unusually excellent magnetic properties and heat resistance is obtained even when molding at low pressure as in sample No. 3-2 (▲), because of the ferromagnetic fluid flayer that appears during magnetic field heat molding.

Finally, the ferromagnetic fluid layer has the following effects.

During magnetic field heat molding of the bonded magnet, the ease of rotation and the ease of position control of the anisotropic magnet powder are improved. Fractures in the Co-less R1 d-HDDR coarse magnet powder during molding are deterred, and irreversible loss rate is improved. Filling factor and orientation of the anisotropic magnet powder increase, and further, these improvements in filling factor and orientation improve (BH) max.

During magnetic field heat molding of the bonded magnet, the ferromagnetic fluid layer makes it possible to shorten the moving distance of R2 fine magnet powder and resin, and deter uneven distribution of the R2 fine magnet powder. By evenly distributing the ferromagnetic fluid layer between constituent grains of Co-less R1 d-HDDR coarse magnet powder, individual grains of Co-less R1 d-HDDR coarse magnet powder are prevented from directly touching each other, increasing the fracture deterrence effect. Particularly, with the manifestation of a lubrication effect, the ferromagnetic fluid layer helps decrease irreversible loss rate and deter fractures in the Co-less R1 d-HDDR coarse magnet powder, due to relief of stress concentration which accompanies uneven distribution of the R2 fine magnet powder, and the roller action of spherical-shaped R2 fine magnet powder existing evenly across the whole surface of Co-less R1 d-HDDR coarse magnet powder. Also, gaps formed between constituent grains of Co-less R1 d-HDDR coarse magnet powder are filled, improving the filling factor, and increasing (BH)max and irreversible loss rate of the bonded magnet. Moreover, by deterring uneven distribution of R2 fine magnet powder, uniformity of surface flux in the bonded magnet is obtained, making it is easy to stabilize quality during mass production of the bonded magnet.

As mentioned above, in the present specification, so that the effectiveness of this ferromagnetic fluid layer can be objectively compared, the fluidity and good filling were evaluated by changing molding pressure with molding temperature a constant 120° C., magnetic field 2.0 MA/m (2.5 T), and measuring the relative density obtained during magnetic field heat molding. Fundamentally, it is not possible to divide fluidity and good filling, but for convenience' sake, they were evaluated in the example embodiments in the following manner.

With respect to fluidity, the relative density of a bonded magnet obtained by magnetic field heat forming under conditions of molding temperature 120° C., magnetic field 2.0 MA/m (2.5 T), and 392 MPa was chiefly used. When magnetic field heat molding of the bonded magnet is performed, with ample fluidity obtained from the ferromagnetic fluid layer, the relative density of the bonded magnet is an unusually high value of 91-99%, 93-99%, or 95-99%. Conversely, when the ferromagnetic fluid layer is not formed, the relative density falls to less than 91%, fluidity is insufficient, and it can be said that the Co-less R1 d-HDDR coarse magnet powder and R2 fine magnetic powder have low ease of rotation and position control. The bonded magnet obtained then can not have both high magnetic properties and desirable heat resistance. The upper limit of relative density is less than 99% because that is the manufacturing limit at commercial levels of production.

With respect to good filling, the relative density of a bonded magnet obtained by magnetic field heat molding under conditions of molding temperature 150° C., magnetic field 2.0 MA/m (2.5 T), and 882 MPa (pressure conferred during final product molding in industrial manufacturing) was chiefly used. With relative density less than 91%, it is not possible to have both high magnetic properties and good heat resistance. The reason for the upper limit of relative density being 99% is just as mentioned above.

EXAMPLE EMBODIMENTS

The present invention will now be more concretely explained giving example embodiments.

(A) First Example Embodiment and Second Example Embodiment (Sample Production)

(1) NdFeB Coarse Magnet Powder (Co-Less R1 d-HDDR Coarse Magnet Powder)

(i) As raw ingredients for the bonded magnet, anisotropic magnet powders having the compositions shown in Chart 1A (first example embodiment), Chart 2A (second example embodiment), and Chart 3A (first comparison example) were produced with the d-HDDR treatment. Specifically, prepared alloy ingot (30 kg) was first melted/cast and made into the composition shown in each chart. Homogenization treatment was performed on this ingot in an argon gas environment at 1140-1150° C. for 40 hours (however, samples No. 2-2 and 2-3 are excepted). This ingot was pulverized by jaw crusher to coarse powder with average grain diameter of 10 mm or less. A d-HDDR treatment, comprised of a low-temperature hydrogenation step, high-temperature hydrogenation step, evacuation step, and desorption step, was then performed on this coarse powder under the following conditions. At room temperature, under hydrogen gas atmosphere with 100 kPa hydrogen pressure, hydrogen was well absorbed into the alloy of each sample (low temperature hydrogenation step).

Next, a 480 minute heat treatment was performed (high temperature hydrogenation stage) under an 800° C. 30 kPa (hydrogen pressure) hydrogen gas atmosphere. In succession, holding at 800° C., a 160 minute heat treatment was performed (evacuation step) under a hydrogen gas atmosphere with 0.1-20 kPa hydrogen pressure. Last, a vacuum was pulled for 60 minutes with a rotary pump and dispersion pump, and then the material was cooled under a vacuum atmosphere of 10-1 Pa or less (desorption step). In this manner, 10 kg of NdFeB d-HDDR anisotropic magnet powder (Co-less R1 d-HDDR anisotropic magnet powder) was made per each batch.

The NdFeB coarse magnet powder shown in Chart 1A was made from Co-less R1 d-HDDR anisotropic magnet powder that does not contain Co. The NdFeB coarse magnet powder shown in Chart 2A was made from Co-containing R1 d-HDDR anisotropic magnet powder that does include Co. Below, both anisotropic magnet powders are brought together and simply called "NdFeB anisotropic magnet powder". The average grain diameter shown in the middle of the graph is the average grain diameter as raw material magnet powder before bonded magnet molding. This average diameter is found by measuring the weight of each grade after sieve analysis, and taking the weighted average of those measurements.

(ii) Next, a solution of surfactant was added to each NdFeB anisotropic magnet powder mentioned above, and they were vacuum dried while stirring (#1 coating process). For the surfactant solution, the silane coupling agent (made by Japan Yurika Corp., NUC silicon A-187) was doubly diluted in ethanol. However, with respect to sample No. 1-3, a solution with the titanate coupling agent (Ajinomoto Corp., Plenact KR41 (B)) doubly diluted in methylethylketone was used for the surfactant solution.

NdFeB coarse magnet powder (Co-less R1 d-HDDR coarse magnet powder) made from NdFeB anisotropic magnet powder with grain surface coated by surfactant was thus obtained. However, coating was not performed with respect to samples No. C1 and C2 shown in Chart 3A.

(2) SmFeN Fine Magnet Powder (R2 Fine Magnet Powder)

For R2 anisotropic magnet powder, publicly marketed SmFeN anisotropic magnet powder (Sumitomo Metal Mining Co., Ltd.) or publicly marketed SmFeN anisotropic magnet powder (Nichia Co.) with an average grain aspect ratio of 1 to 2 was prepared. The average aspect ratio of samples No. 1-1 through 1-4 and No. 2-1 through 2-4 was 1.6, and the average aspect ratio was 1.1 for samples No. 1-5 through 1-10, No. 2-5 through 2-6, No. B1 through F2, and No. H1 through H6.

To this SmFeN anisotropic magnet powder, a solution of surfactant, (silane coupling agent) same as in the case of the above-mentioned NdFeB anisotropic magnet powder was added, and the mixture was vacuum dried while stirring (#2 coating process). Each type of R2 magnet powder (SmFeN magnet powder) is comprised of grains whose surface is coated by surfactant was obtained in this manner. However, this surfactant coating was not performed for samples No. C2 and No. C3 in Chart 3A. And, in samples No. B1 and B2 in Chart 3, only NdFeB coarse magnet powder was used, without using SmFeN fine magnet powder.

For the method of surfactant coating, besides the above stated method, it is acceptable, for example, to mix combined NdFeB anisotropic magnet powder and SmFeN anisotropic magnet powder with a Henshel mixer, add surfactant solution, then stir and vacuum dry, coating both anisotropic magnet powders at the same time.

(3) Compound

Using the mixture ratio (wt %) shown in Chart 1A, Chart 2A, and Chart 3A, the above-cited NdFeB coarse magnet powder and SmFeN fine magnet powder were respectively mixed with a Henshel mixer. Epoxy resin was added to that mixture in the ratios shown in each chart (mixing process), and a compound obtained by performing heat kneading at 110° C. with a Banbury mixer (heat kneading process). For this kneading, besides the above-cited Banbury mixer, other kneading-type machines may be used.

When it has not received any heat history, the above-mentioned epoxy resin used here has a softening point of 90° C., and hardening temperature (hardening point) of 150° C. The above-mentioned heat kneading process is performed at a temperature range (90-130° C.) above the softening point and below the hardening point of the epoxy resin. The hardening temperature indicates the temperature at which 95% of the resin has completed the hardening reaction when heated for 30 minutes.

At a heat kneading temperature less than the resin softening point, the resin does not turn to a melted state and it is not possible to evenly disperse SmFeN fine magnet powder in the resin. When the heat kneading temperature is above the hardening point of the resin, even if the resin coats around the magnet powder and can be evenly dispersed, the hardening of the resin advances. Therefore, subsequent magnetic field orientation becomes difficult, and a drastic reduction in the magnetic properties of the bonded magnet may be invited. Here, "evenly dispersed" means a state in which both the epoxy resin is present between the SmFeN fine magnet powder and NdFeB coarse magnet powder, and also SmFeN fine magnet powder is evenly distributed on the surface of NdFeB coarse magnet powder.

For samples No. B1 and B2 in Chart 3A, the compound was made by heat kneading only NdFeB coarse magnet powder and resin.

(4) Bonded Magnet

Bonded magnets were produced with each compound to use for magnetic measurements. To mold the bonded magnets, heat molding was performed (heat molding process) with molding pressure 882 MPa (9 ton/cm$^2$) while applying a molding temperature 150° C., 2.0 MA/m magnetic field (heat orientation process).

To confirm the low pressure molding of the present invention, heat molding was performed (heat molding process) with molding pressure 392 MPa (4 ton/cm$^2$) while applying a molding temperature 150° C., 2.0 MA/m magnetic field (heat orientation process). Each process mentioned above was consecutively performed (i.e., one-step molding) in a molding die filled with compound. Doing so, a 7×7×7 mm cube-shaped molded body was obtained. Magnetizing was performed in a 4.0 T magnetic field by using a hollow coil and adding 10000 A exciting current to the obtained molded body (magnetizing process), making the molded body into a compound rare-earth anisotropic bonded magnet.

Hardening treatment is not implemented in this example embodiment, but when actually using the bonded magnet in various types of products, it is fine to perform heat hardening treatment in order to increase strength.

(Sample Measurements)

(1) For the bonded magnets used for taking measurements, made from each sample shown in Chart 1A, Chart 2A, and Chart 3A, normalized grain count where per unit area apparent grain diameter of NdFeB coarse magnet powder is 20 μm or less, magnetic properties, irreversible loss rate, and relative density were each measured according to the above-mentioned measurement method. Specifically, as follows.

Maximum energy product of the bonded magnet was measured with a BH tracer (Riken Electronics Sales Co., BHU-25) Irreversible loss rate was calculated by taking the difference between the initial magnetic flux of the molded bonded magnet and the magnetic flux obtained when remagnetizing the magnet after being held in 100° C. and 120° C. atmospheric environments for 1000 hours, and then finding the ratio of that reduction in flux to the initial magnetic flux. A Model FM-BIDSC (DENSHI JIKI Co.) was used for measuring flux.

Relative density (ρ) is calculated from the cubic volume, which is found from the dimensions in micrometers of the molded body after press molding, and the weight of the molded body measured with an electronic balance. Dividing that relative density by the theoretical density of the molded body, found from the true density and mixture ratio of magnet powder and resin used in each sample, yields the relative density (ρ/ρth) of the molded body. The normalized grain count of NdFeB coarse magnet powder in the bonded magnet, where per unit area apparent grain diameter is 20 μm or less, is calculated as in the previously-mentioned procedure. The results of these calculations are shown in Charts 1B and 2B-3.

Figure 4:
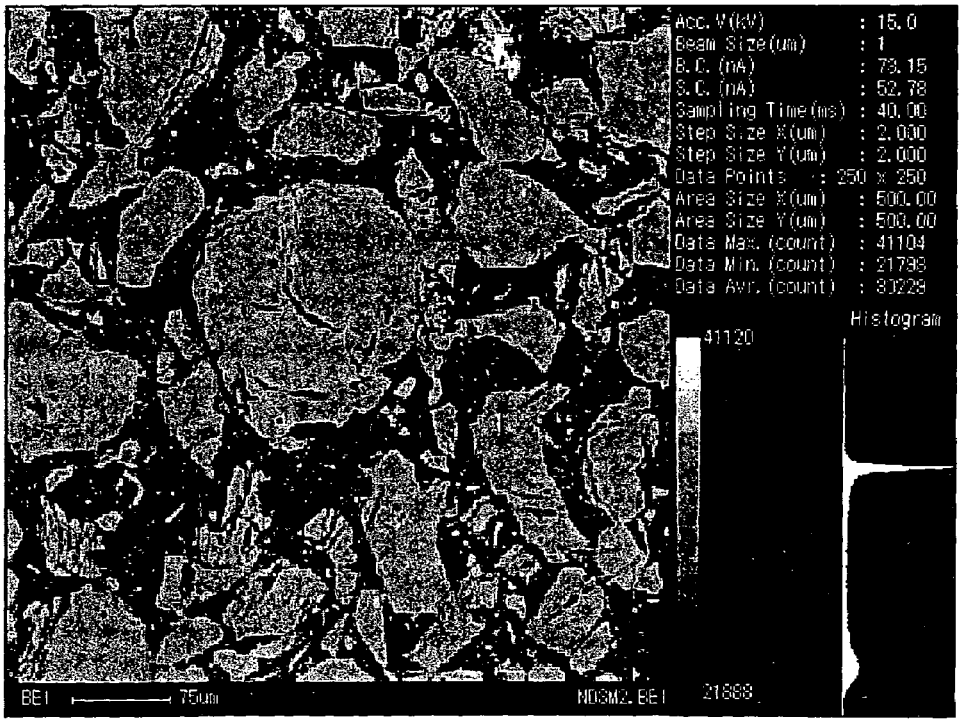
FIG. 4: A scanning electron microscope (SEM) 2D electron image photograph observing the composite rare-earth anisotropic bonded magnet involved in the present invention; it takes notice of metallic powder in the bonded magnet.
Figure 5:
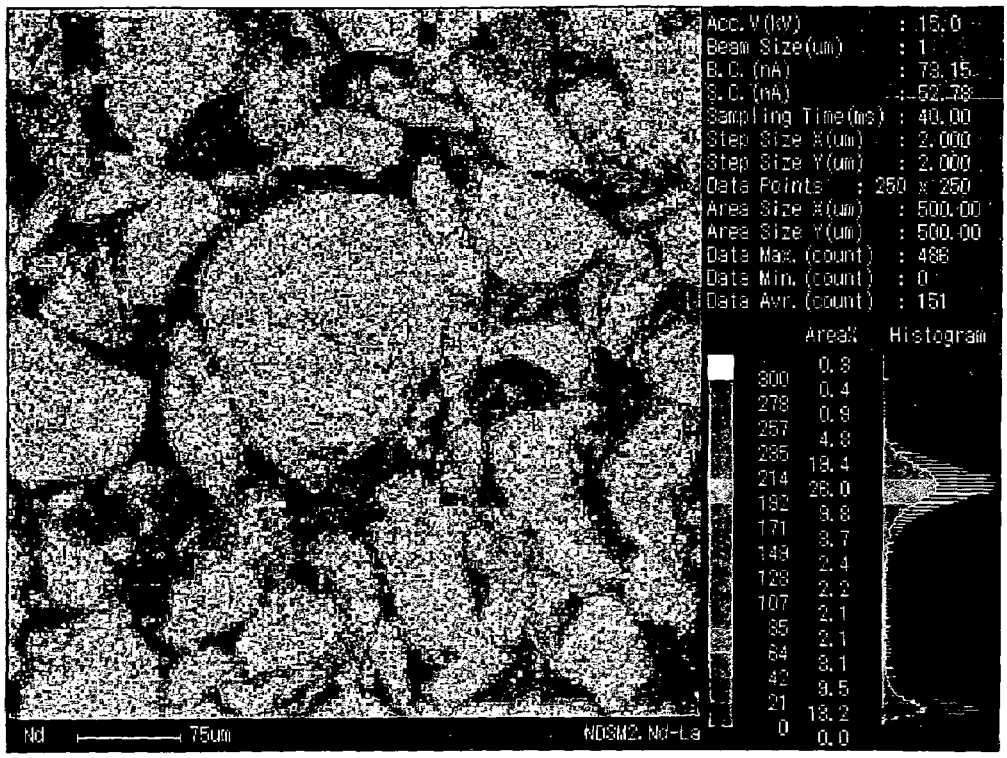
FIG. 5: Nd electron probe microanalysis (EPMA) image photograph observing the composite rare-earth anisotropic bonded magnet involved in the present invention; it takes notice of the Nd element in the NdFeB coarse magnet powder.
Figure 6:
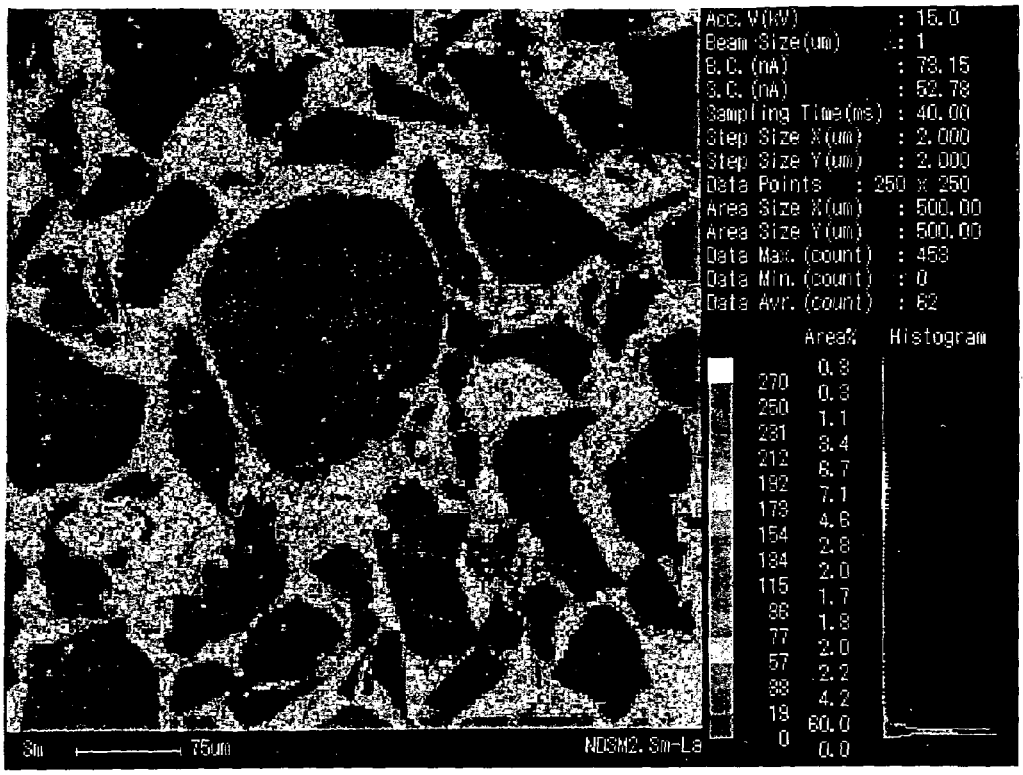
FIG. 6: Sm electron probe microanalysis (EPMA) image photograph observing the composite rare-earth anisotropic bonded magnet involved in the present invention; it takes notice of the Sm element in the R2 fine magnet powder.
Figure 7:
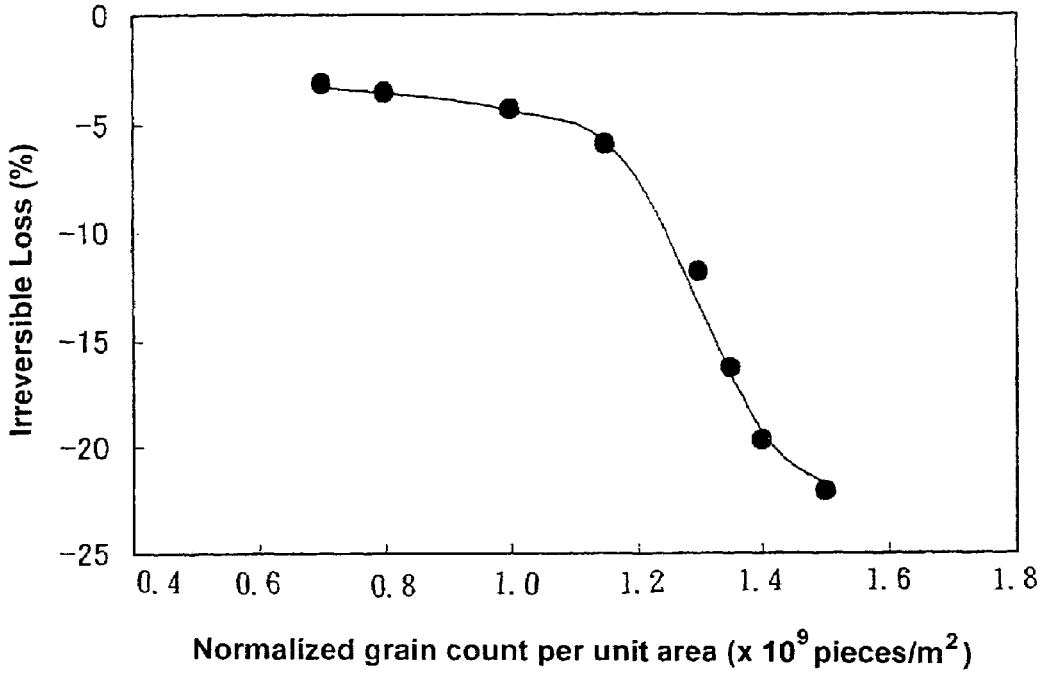
FIG. 7: A graph of the relationship between the normalized grain count per unit area of NdFeB coarse magnet powder in the bonded magnet and the irreversible loss rate.

(2) SEM observation photographs of the bonded magnet made from sample No. 1-1 of Charts 1A, B are shown in FIGS. 4-6. These pictures were taken using an EPMA-1600 made by Shimadzu Corporation.

FIG. 4 shows a 2D electron image. FIG. 5 shows an Nd element EPMA image. In FIG. 5, a thickening concentration of the Nd element is shown in order from blue to yellow to red, and it is understood from the thickening of Nd in large diameter grains that those grains are grains of NdFeB anisotropic magnet powder.

FIG. 6 is an EPMA image of the Sm element. In FIG. 6, a thickening concentration of the Sm element is shown in order from blue to yellow to red. From this figure, it is seen that the surrounding surfaces of all the large diameter grains (grains of NdFeB anisotropic magnet powder) are blanketed by grains of SmFeN anisotropic magnet powder, and that in the gaps formed between the large diameter grains made of NdFeB anisotropic magnet powder, small diameter grains of SmFeN anisotropic magnet powder are evenly and densely dispersed.

(Evaluation)

The following is understood from the above results.

(1) First Comparison Example and Second Comparison Example

The samples for both the first comparison example and second comparison example have the average grain diameter and compounding ratio stated in the present invention. Both bonded magnets show high magnetic properties with (BH) max of 134 kJ/m$^3$ or more.

With respect to irreversible loss rate, an index of heat resistance, all samples show excellent irreversible loss properties under −10%, at −5% or less (under a 100° C. environment). Particularly, even for irreversible loss rate under a 120° C. environment, all samples show excellent irreversible loss rate of −6.5% or less. And each sample shows a high relative density of 91% or greater, which along with indicating the fluidity of NdFeB coarse magnet powder when heat molding the bonded magnet, also exerts a great influence on magnetic properties and heat resistance. Relative density was high in the case of each sample regardless of unevenness in molding pressure. Therefore, a high level of fluidity and even dispersion (good filling) is exhibited during heat molding of the bonded magnet, confirming the ability to manage a high level of both fracture control and filling factor.

The bonded magnets of samples No. 2-2 and 2-3 aim to decrease manufacturing cost by increasing the amount of included B and abbreviating the homogenized heat treatment. The bonded magnets of samples No. 1-4, 2-2, and 2-3 further increase irreversible loss rate by including La, which functions as an oxygen-getter. Compared to the bonded magnet of sample No. 1-1, (BH)max for these bonded magnets is somewhat decreased, but with irreversible loss rate −3.4% or less (100° C.) in each case, they have unusually outstanding heat resistance.

The bonded magnet of sample No. 1-5 is a low-cost type with a decreased mixture amount of NdFeB coarse magnet powder. Due to the reduction of NdFeB coarse magnet powder, (BH)max of the bonded magnet is somewhat lessened, but with irreversible loss rate −4.5% (100° C.), it shows excellent heat resistance.

The normalized grain count of NdFeB coarse magnet powder included in each bonded magnet of the first and second example embodiments, where per unit area apparent grain diameter is 20 μm or less, is an unusually small $0.7\text{-}0.9\times10^{9}$ pieces/$m^2$ in each case.

Comparing the bonded magnet of the first example embodiment and the bonded magnet of the second example embodiment, both (BH)max and irreversible loss rate do not differ greatly, and in each case there are excellent magnetic properties and heat resistance. Particularly, as understood from looking at irreversible loss rate, the Co-less bonded magnet of the first example embodiment has properties at a level similar to the Co-containing bonded magnet of the second example embodiment.

By considering the above, and excluding types of bonded magnets which attach great importance to economy and heat resistance, an unusually high performance bonded magnet was successfully obtained, with maximum energy product (BH)max 164.0 to k207 kJ/$m^3$, 1000 Hr 120° C. irreversible loss rate −5.0 to −6.1%, and 1000 Hr 100° C. irreversible loss rate −3.3 to −3.9%, even while using Co-less NdFeB d-HDDR anisotropic magnet powder and not including Co. Particularly, in contrast to the bonded magnet in above-mentioned patent documents 8-11, which is made by using Co-containing HDDR anisotropic magnet powder and has maximum energy product (BH)max 142-164.7 kJ/$m^3$, and 100° C.×1000 Hr irreversible loss rate −2.6 to −4.7%, it was possible in the present example embodiment to obtain a bonded magnet exhibiting high magnetic properties and high heat resistance at about the same level as conventional bonded magnets, without the need to use anisotropic magnet powder including cobalt.

(2) Second Comparison Example

Samples No. B1 and B2 are bonded magnets without SmFeN fine magnet powder, corresponding to the conventional technology. For either one, (BH)max and irreversible loss rate are poor. This is clearly due to relative density and to the fact that in the bonded magnet, normalized grain count with per unit area of the apparent grain diameter at 20 μm or less is increased to $1.2\times10^{9}$ pieces/$m^2$ or more. In particular, in sample B2, despite attempting for high density with high pressure molding, relative density did not exceed a mere 89%. In this case, the irreversible loss rate is strikingly worse, particularly at 120° C.

In samples No. C1 and C2, a coating treatment by surfactant is applied to either one or both of the magnet powders. In either case, the relative density is low when molding at low pressure (392 MPa). It is thought that in the case of sample No. C1, this low relative density was due to the fact that the NdFeB anisotropic magnet powder and ferromagnetic fluid layer had low fluidity during heat molding of the bonded magnet, because there was no surfactant coating on the surface of NdFeB anisotropic magnet powder. It is thought that in the case of sample No. C2, this low relative density was due to the fact that because SmFeN anisotropic magnet powder was not coated by surfactant, a ferromagnetic fluid layer evenly distributed in the resin was not formed at all, and fluidity provided by the ferromagnetic fluid layer was not obtained during heat molding of the bonded magnet. It is thought that in the case of sample No. C3, this low relative density was due to the fact that because neither of the anisotropic magnet powders were coated by surfactant, the fluidity of the magnet powder and resin during heat molding of the bonded magnet was greatly deteriorated. Naturally, when this happens (BH)max and irreversible loss rate become quite poor.

In samples No. C1 through C3, when molding pressure of 392 MPa is used, filling factor is poor with relative density being a low 85-87%. Due to deterioration in fluidity, the NdFeB coarse magnet powder fractures during heat molding of the bonded magnet, and the normalized grain count of NdFeB coarse magnet powder included in the bonded magnet, where per unit area apparent grain diameter is 20 μm or less, is more than $1.2\times10^{9}$ pieces/$m^2$ in each sample. Irreversible loss rate decreases along with that increase in normalized grain count. This is thought to be because with no surfactant on the surface of the magnet powder, adhesion to the resin (soaking) is poor and oxidation easily progresses.

In sample No. D1, the average grain diameter of NdFeB coarse magnet powder is too small. Conversely, in sample No. D2 the average grain diameter is too big. In both cases, (BH)max is greatly decreased. Accordingly, in order to obtain high heat resistance along with high magnetic properties, it is also necessary for the average grain diameter of NdFeB coarse magnet powder to be within the limits of the present invention.

In sample No. E1, the mixture amount of NdFeB coarse magnet powder is too small. In sample No. E2, the mixture amount is too large. When the mixture amount of NdFeB coarse magnet powder is too small, the magnetic properties of that part deteriorate. Because it is widely known that sufficient density is not obtained when SmFeN fine magnet powder is not molded at high pressure (980 MPa or more), when the mixture amount of NdFeB coarse magnet powder is small (i.e., when the mixture amount of SmFeN fine magnet powder increases), magnetic properties deteriorate. On the other hand, even when that mixture amount is large, because the mixture amount of SmFeN fine magnet powder is relatively small, a sufficient ferromagnetic fluid layer is not formed at the time of molding the bonded magnet. As a result, relative density deteriorates, and without SmFeN grains being able to coat the surface of NdFeB grains, fractures are easily generated in the NdFeB coarse magnet powder and heat resistance (irreversible loss rate) decreases. This is also understood from the fact that the normalized grain count of NdFeB coarse magnet powder in the bonded magnet, where per unit area apparent grain diameter is 20 μm or less, is larger than $1.2\times10^{9}$ pieces $m^2$.

In sample No. F1, the mixture amount of resin is inadequate. In sample No. F2, the mixture amount of resin is too great. In the case of sample No. F1, the ferromagnetism fluid layer is inadequately formed when heat molding the bonded magnet, and the irreversible loss rate decreases due to fractures in the NdFeB coarse magnet powder. In the case of sample No. F2, the magnetic properties of the bonded magnet diminish because the mixture amount of magnet powder is comparatively less.

It is understood from the above that to obtain a bonded magnet with outstanding magnetic properties and heat resistance, along with using SmFeN fine magnet powder and NdFeB coarse magnet powder on which a coating treatment has been performed with surfactant, it is also necessary to set a suitable range of average grain diameters and compounding ratios for the powders.

(B) Third Example Embodiment (Sample Production and Measurement)

Each type of bonded magnet having to do with the third example embodiment and second comparison example was prepared by variously altering the production conditions for the compound used in molding the bonded magnet (heat kneading temperature), and production conditions for the bonded magnet using that compound (molding temperature and molding pressure) The compound production conditions and bonded magnet production conditions, and the examined magnetic properties, relative density, irreversible loss rate and even dispersion of the obtained bonded magnet are shown in Chart 4.

The types of NdFeB coarse magnet powder, SmFeN fine magnet powder, resin and mixture amount used here are the same as in sample No. 1-1 of the first example embodiment. The production conditions of the other bonded magnets and the measurement method is also the same as in the case of the first example embodiment.

(Evaluation)

The following is clear from the results shown in Chart 4. For samples No. 3-1 and 3-2, the magnet powder and resin were heat kneaded at a temperature greater than the resin softening point and less than the hardening point, and using the obtained compound, molded within a heated magnetic field at that temperature.

In samples No. H1-H5, the bonded magnet was made from a compound produced by kneading each magnet powder and resin at room temperature. Each magnet powder and resin in this type of compound are thought to be always intermingled in uneven distribution. In other words, formation of the desired ferromagnetic fluid layer is difficult, and a state in which epoxy resin definitely exists between the SmFeN fine magnet powder and NdFeB coarse magnet powder, and moreover, in which SmFeN fine magnet powder is evenly dispersed around the NdFeB coarse magnet powder, is not formed at the time of molding the bonded magnet. Therefore, as understood from looking at the relative density when molding pressure is 392 MPa, there is low fluidity during magnetic field heat molding. In contrast to the 97.0% relative density of the present invention, in the case of samples No. H1-H5, as detailed in FIG. 3, relative density deteriorates to a lower limit of 85.0% at an ordinary molding pressure of 882 MPa due to poor fluidity, and magnetic properties better than the conventional technology are not obtained.

Attempting for relative density of the bonded magnet equal to the 97.0% level seen in sample No. 3-1, the molding pressure was raised to 1960 MPa, more than twice that of sample No. H2, and magnetic field heat molding was performed (sample No. H7). By increasing relative density to 97.0%, magnetic properties were increased, but the same level of magnetic properties as sample No. 3-1 were not obtained. The grain count in this instance was $1.5\times10^9$ pieces/m$^2$, greatly exceeding the $1.2\times10^9$ pieces/m$^2$ of the present invention. Accordingly, irreversible loss rate decreased dramatically.

Therefore, when not made according to the production method of the present invention, a ferromagnetic fluid layer was not formed, making it difficult to obtain high fluidity and good filling when molding the bonded magnet. Without obtaining high filling factor and fracture control, the combination of both excellent (BH)max value and excellent irreversible loss properties could not be obtained.

Sample No. H6 was made with a compound produced by heat kneading each magnet powder and resin above the hardening point of the resin, and magnetic field heat molding the compound at the same temperature. In this case, the even dispersion of SmFeN fine magnet powder on the surface of NdFeB coarse magnet powder was good. However, because the resin hardening continued to advance during the compound production stage, the resin did not sufficiently soften during the subsequent heat molding of the bonded magnet. As a result, a ferromagnetic fluid layer with abundant fluidity was not obtained, magnetic field orientation of the NdFeB coarse magnet powder was also inadequate, and the magnetic properties of the bonded magnet diminished greatly.

From the above results, it is clear that to obtain a bonded magnet with high magnetic properties and high heat resistance, it is most desirable to produce the bonded magnet by magnetic field heat molding a compound in which magnet powder that has been coated with surfactant and resin is heat kneaded.

CHART 1A

| Sample | | NdFeB Coarse Magnet Powder (Co-less) | | | | | | | | | | | | | SmFeN Fine Magnet Powder 10% Sm—7% Fe—13% N(at %) | | | Epoxy |
|---|---|---|---|---|---|---|---|---|---|---|---|---|---|---|---|---|---|---|
| | | Composition (at %) | | | | | | | | | | | Average Grain Diameter | Mixture Ratio | | Average Grain Diameter | Mixture Ratio | Resin Mixture Ratio |
| | No. | Nd | Dy | B | Fe | Ga | Nb | Zr | Co | La | Pr | Surfactant | (μm) | (%) | Surfactant | (μm) | (%) | (%) |
| First | 1-1 | 12.5 | — | 6.4 | Bal. | 0.3 | 0.2 | — | — | — | — | Yes | 106 | 78 | Yes | 3 | 20 | 2 |
| Example | 1-2 | 12.5 | 0.5 | 6.4 | Bal. | 0.3 | 0.2 | — | — | — | — | Yes | 150 | 76 | Yes | 3 | 22 | 2 |
| Embodi- | 1-3 | 13.5 | 0.5 | 6.4 | Bal. | 0.3 | 0.2 | — | — | — | — | Yes | 75 | 77 | Yes | 3 | 21 | 2 |
| ment | 1-4 | 12.8 | — | 6.4 | Bal. | 0.3 | 0.2 | — | — | 0.5 | — | Yes | 106 | 75 | Yes | 3 | 23 | 2 |
| | 1-5 | 12.5 | — | 6.2 | Bal. | — | — | — | — | — | — | Yes | 90 | 62.5 | Yes | 2 | 35 | 2.5 |
| | 1-6 | 12.0 | — | 6.2 | Bal. | 0.3 | 0.2 | — | — | — | 0.5 | Yes | 88 | 63 | Yes | 2 | 35 | 2 |
| | 1-7 | 12.5 | — | 6.4 | Bal. | 0.3 | 0.2 | — | — | — | — | Yes | 79 | 80 | Yes | 2 | 18 | 2 |

CHART 1A-continued

| Sample No. | NdFeB Coarse Magnet Powder (Co-less) Composition (at %) Nd | Dy | B | Fe | Ga | Nb | Zr | Co | La | Pr | Surfactant | Average Grain Diameter (μm) | Mixture Ratio (%) | SmFeN Fine Magnet Powder 10% Sm—7% Fe—13% N(at %) Surfactant | Average Grain Diameter (μm) | Mixture Ratio (%) | Epoxy Resin Mixture Ratio (%) |
|---|---|---|---|---|---|---|---|---|---|---|---|---|---|---|---|---|---|
| 1-8 | 13.5 | 0.5 | 6.4 | Bal. | 0.3 | 0.2 | — | — | — | — | Yes | 66 | 75 | Yes | 3 | 22.5 | 1.5 |
| 1-9 | 12.5 | — | 6.4 | Bal. | 0.3 | 0.2 | — | — | — | — | Yes | 127 | 83 | Yes | 3 | 15.5 | 1.5 |
| 1-10 | 12.5 | 0.2 | 6.2 | Bal. | 0.3 | 0.2 | — | — | — | — | Yes | 130 | 78 | Yes | 3 | 20 | 2 |

Heat kneading temperature: 120° C., magnetic field molding conditions: 150° C. × 882 MPa

CHART 1B

| Sample No. | | Max Energy Product (BH)max (kJ/m$^3$) | Relative Density (%) Molding Pressure 392 MPa | Molding Pressure 882 MPa | Irreversible Loss (%) Atmospheric Temperature 100° C. | Atmospheric Temperature 120° C. | Normalized grain count of NdFeB coarse magnet powder in the bonded magnet (×10$^9$ pieces/m$^2$) | Even dispersion of SmFeN fine magnet powder on the entire surface of NdFeB coarse magnet powder |
|---|---|---|---|---|---|---|---|---|
| First Example Embodiment | 1-1 | 184 | 95 | 97.5 | −3.7 | −6.1 | 0.79 | ○ |
| | 1-2 | 171 | 96 | 97.5 | −3.5 | −5.5 | 0.82 | ○ |
| | 1-3 | 164 | 95 | 96 | −3.3 | −5.0 | 0.86 | ○ |
| | 1-4 | 145 | 95 | 97 | −3.4 | −4.9 | 0.93 | ○ |
| | 1-5 | 134 | 94 | 96 | −4.5 | −6.5 | 0.74 | ○ |
| | 1-6 | 185 | 93 | 96 | −4.3 | −6.2 | 0.72 | ○ |
| | 1-7 | 180 | 94 | 98 | −3.6 | −5.9 | 0.89 | ○ |
| | 1-8 | 170 | 91 | 94 | −3.3 | −5.1 | 0.91 | ○ |
| | 1-9 | 192 | 96 | 97.5 | −3.7 | −6.0 | 0.73 | ○ |
| | 1-10 | 207 | 96 | 98 | −3.5 | −5.1 | 0.70 | ○ |

Chart 1B "○" represents "excellent".

CHART 2A

| Sample No. | | NdFeB Coarse Magnet Powder (Co-containing) Composition (at %) Nd | Dy | B | Fe | Ga | Nb | Zr | Co | La | Pr | Surfactant | Average Grain Diameter (μm) | Mixture Ratio (%) | SmFeN Fine Magnet Powder 10% Sm—7% Fe—13% N(at %) Surfactant | Average Grain Diameter (μm) | Mixture Ratio (%) | Epoxy Resin Mixture Ratio (%) |
|---|---|---|---|---|---|---|---|---|---|---|---|---|---|---|---|---|---|---|
| Second Example Embodiment | 2-1 | 12.5 | — | 6.4 | Bal. | 0.3 | 0.2 | — | 3.0 | — | — | Yes | 106 | 75 | Yes | 3 | 23 | 2 |
| | 2-2 | 12.3 | — | 12.1 | Bal. | 0.3 | 0.2 | — | 3.0 | 0.02 | — | Yes | 80 | 80 | Yes | 2 | 18 | 2 |
| | 2-3 | 12.5 | 0.7 | 12.0 | Bal. | 0.3 | 0.2 | — | 5.0 | 0.3 | — | Yes | 122 | 80 | Yes | 2 | 18 | 2 |
| | 2-4 | 12.3 | — | 6.3 | Bal. | 0.3 | 0.2 | — | 6.0 | — | — | Yes | 68 | 75 | Yes | 3 | 22.5 | 1.5 |
| | 2-5 | 12.6 | — | 6.5 | Bal. | 0.3 | — | 0.1 | 5.0 | — | — | Yes | 125 | 83 | Yes | 3 | 15.5 | 1.5 |
| | 2-6 | 12.8 | — | 6.0 | Bal. | 0.5 | — | 0.1 | 4.6 | — | — | Yes | 130 | 72 | Yes | 2 | 25.5 | 2.5 |

Heat kneading temperature: 120° C., magnetic field molding conditions: 150° C. × 882 MPa

CHART 2B

| Sample No. | | Heat Kneading Temperature (° C.) | Magnetic Field Molding Conditions Temperature (° C.) | Molding Pressure (MPa) | Max Energy Product (BH)max (kJ/m$^3$) | Relative Density (%) Molding Pressure 392 MPa | Molding Pressure 882 MPa | Irreversible Loss (%) Atmospheric Temperature 100° C. | Atmospheric Temperature 120° C. | Normalized grain count of NdFeB coarse magnet powder in the bonded magnet (×10$^9$ pieces/m$^2$) | Even dispersion of SmFeN fine magnet powder on the entire surface of NdFeB coarse magnet powder |
|---|---|---|---|---|---|---|---|---|---|---|---|
| Second Example | 2-1 | 120 | 150 | 882 | 201 | 94 | 95 | −4.8 | −5.1 | 0.81 | ○ |
| | 2-2 | ↑ | ↑ | ↑ | 145 | 95 | 97 | −3.4 | −4.9 | 0.79 | ○ |

CHART 2B-continued

| Sample No. | | Heat Kneading Temperature (° C.) | Magnetic Field Molding Conditions Temperature (° C.) | Magnetic Field Molding Conditions Molding Pressure (MPa) | Max Energy Product (BH)max (kJ/m³) | Relative Density (%) Molding Pressure 392 MPa | Relative Density (%) Molding Pressure 882 MPa | Irreversible Loss (%) Atmospheric Temperature 100° C. | Irreversible Loss (%) Atmospheric Temperature 120° C. | Normalized grain count of NdFeB coarse magnet powder in the bonded magnet (×10⁹ pieces/m²) | Even dispersion of SmFeN fine magnet powder on the entire surface of NdFeB coarse magnet powder |
|---|---|---|---|---|---|---|---|---|---|---|---|
| Embodiment | 2-3 | ↑ | ↑ | ↑ | 153 | 96 | 97 | −3.2 | −4.8 | 0.89 | ○ |
| | 2-4 | ↑ | ↑ | ↑ | 206 | 96 | 97.5 | −3.4 | −5.2 | 0.72 | ○ |
| | 2-5 | ↑ | ↑ | ↑ | 180 | 95 | 97 | −3.4 | −5.4 | 0.83 | ○ |
| | 2-6 | ↑ | ↑ | ↑ | 172 | 94 | 97 | −3.5 | −5.6 | 0.74 | ○ |

In Chart 2B "○" represents "excellent" and "x" represnets "poor".

CHART 3A

| Sample No. | | NdFeB Coarse Magnet Powder (Co-less) Composition (at %) Nd | Dy | B | Fe | Ga | Nb | Zr | Co | La | Pr | Surfactant | Average Grain Diameter (μm) | Mixture Ratio (%) | SmFeN Coarse Magnet Powder 10% Sm—7% Fe—13% N(at %) Surfactant | Average Grain Diameter (μm) | Mixture Ratio (%) | Epoxy Resin Mixture Ratio (%) |
|---|---|---|---|---|---|---|---|---|---|---|---|---|---|---|---|---|---|---|
| First Comparison Example | B1 | 12.5 | — | 6.4 | Bal. | 0.3 | 0.2 | — | — | — | — | Yes | 106 | 98 | — | — | — | 2 |
| | B2 | 12.5 | — | 6.4 | Bal. | 0.3 | 0.2 | — | — | — | — | Yes | 106 | 98 | — | — | — | 2 |
| | C1 | 12.7 | — | 6.2 | Bal. | 0.3 | 0.2 | — | — | — | 0.1 | Yes | 106 | 78 | Yes | 3 | 20 | 2 |
| | C2 | 12.7 | — | 6.2 | Bal. | 0.3 | 0.2 | — | — | — | 0.1 | Yes | 106 | 78 | No | 3 | 20 | 2 |
| | C3 | 12.7 | — | 6.2 | Bal. | 0.3 | 0.2 | — | — | — | 0.1 | Yes | 106 | 78 | No | 3 | 20 | 2 |
| | D1 | 13.5 | 0.5 | 6.4 | Bal. | 0.3 | 0.2 | — | — | — | — | Yes | 45 | 78 | Yes | 3 | 20 | 2 |
| | D2 | 13.5 | 0.5 | 6.4 | Bal. | 0.3 | 0.2 | — | — | — | — | Yes | 425 | 78 | Yes | 3 | 20 | 2 |
| | E1 | 12.5 | — | 6.4 | Bal. | 0.3 | 0.2 | — | — | — | — | Yes | 106 | 45 | Yes | 3 | 53 | 2 |
| | E2 | 12.5 | — | 6.4 | Bal. | 0.3 | 0.2 | — | — | — | — | Yes | 106 | 88 | Yes | 3 | 10 | 2 |
| | F1 | 12.5 | — | 6.4 | Bal. | 0.3 | 0.2 | — | — | — | — | Yes | 106 | 79.5 | Yes | 3 | 20 | 0.5 |
| | F2 | 12.5 | — | 6.4 | Bal. | 0.3 | 0.2 | — | — | — | — | Yes | 106 | 73 | Yes | 3 | 15 | 12 |

Heat Kneading Temperature: 120° C., Magnetic Field Molding Conditions 150° C. × 980 MPa
(Sample No. B1 Magnetic Field Molding Conditions: 150° C. × 882 MPa)

CHART 3B

| Sample No. | | Max Energy Product (BH)max (kJ/m³) | Relative Density (%) Molding Pressure 392 MPa | Relative Density (%) Molding Pressure 882 MPa | Irreversible Loss (%) Atmospheric Temperature 100° C. | Irreversible Loss (%) Atmospheric Temperature 120° C. | Normalized grain count of NdFeB coarse magnet powder in the bonded magnet (×10⁹ pieces/m²) | Even dispersion of SmFeN fine magnet powder on the entire surface of NdFeB coarse magnet powder | Point of Comparison |
|---|---|---|---|---|---|---|---|---|---|
| First Comparison Example | B1 | 145 | 80 | 87 | −18.0 | −29.0 | 1.43 | — | No SmFeN fine magnet powder |
| | B2 | 165 | 82 | 89 | −21.0 | −31.0 | 1.55 | — | No SmFeN fine magnet powder (High density via high pressure) |
| | C1 | 180 | 87 | 94 | −6.6 | −8.2 | 1.21 | x | No surfactant treatment of NdFeB coarse magnet powder |
| | C2 | 182 | 87 | 94 | −7.5 | −9.2 | 1.25 | x | No surfactant treatment of SmFeN fine magnet powder |
| | C3 | 177 | 85 | 94 | −14.2 | −20.2 | 1.30 | x | No surfactant treatment of either magnet powder |
| | D1 | 127 | 94 | 95 | −4.0 | −5.8 | 1.05 | ○ | Below lower limit of NdFeB coarse magnet powder average grain diameter |

CHART 3B-continued

| Sample No. | Max Energy Product (BH)max (kJ/m$^3$) | Relative Density (%) Molding Pressure 392 MPa | Relative Density (%) Molding Pressure 882 MPa | Irreversible Loss (%) Atmospheric Temperature 100° C. | Irreversible Loss (%) Atmospheric Temperature 120° C. | Normalized grain count of NdFeB coarse magnet powder in the bonded magnet (×10$^9$ pieces/m$^2$) | Even dispersion of SmFeN fine magnet powder on the entire surface of NdFeB coarse magnet powder | Point of Comparison |
|---|---|---|---|---|---|---|---|---|
| D2 | 135 | 95 | 96 | −3.5 | −5.0 | 0.72 | ○ | Above upper limit of NdFeB coarse magnet powder average grain diameter |
| E1 | 160 | 90 | 93 | −4.5 | −6.0 | 0.56 | ○ | Below lower limit of NdFeB coarse magnet powder mixing ratio |
| E2 | 175 | 92 | 94 | −6.0 | −7.9 | 1.21 | x (Not entire surface) | Above upper limit of NdFeB coarse magnet powder mixing ratio |
| F1 | 180 | 92 | 93 | −7.0 | −8.8 | 1.26 | ○ | Below lower limit of resin mixture ratio |
| F2 | 130 | 94 | 96 | −3.0 | −5.1 | 0.54 | ○ | Above upper limit of resin mixture ratio |

In Chart 3B "○" represents "excellent" and "x" represnets "poor".

CHART 4

| Sample No. | | Heat Kneading Temperature (° C.) | Magneitc Field Molding Conditions Temperature (° C.) | Magneitc Field Molding Conditions Molding Pressure (MPa) | Max Energy Product (BH)max (kJ/m$^3$) | Relative Density (%) | Irreversible Loss (%) Atmospheric Temperature 100° C. | Even dispersion of SmFeN fine magnet powder on the entire surface of NdFeB coarse magnet powder | Normalized grain count of NdFeB coarse magnet powder in the bonded magnet (×10$^9$ pieces/m$^2$) | Relative Density at Molding Pressure 392 MPa (%) |
|---|---|---|---|---|---|---|---|---|---|---|
| Third Example Embodiment | 3-1 | 120 | 120 | 882 | 184.0 | 97.0 | −3.7 | ○ | 0.81 | 95.0 |
| | 3-2 | ↑ | 150 | ↑ | 180.0 | 97.5 | −3.7 | ○ | 0.85 | 95.0 |
| Second Comparison Example | H1 | Room Temperature | Room Temperature | 882 | 120.0 | 85.0 | −5.1 | x | 0.72 | 75.0 |
| | H2 | ↑ | 120 | 882 | 158.2 | 92.0 | −4.1 | x | 0.84 | 87.0 |
| | H3 | ↑ | ↑ | 980 | 162.0 | 93.0 | −4.4 | x | 0.88 | |
| | H4 | ↑ | 150 | 882 | 157.8 | 92.2 | −4.1 | x | 0.83 | 87.0 |
| | H5 | ↑ | ↑ | 980 | 155.0 | 93.0 | −4.0 | x | 0.90 | |
| | H6 | 150 | 150 | ↑ | 121.3 | 93.0 | −4.2 | ○ | 0.74 | 75.0 |
| | H7 | Room Temperature | 120 | 1960 | 175.3 | 97.0 | −18.9 | x | 1.52 | 87.0 |

CHART 5

| Sample No. | Molding Pressure (MPa) | NdFeB Coarse Magnet Powder Mixture Ratio (Wt %) | SmFeN Fine Magnet Powder Mixture Ratio (Wt %) | NdFeB Coarse Magnet Powder Average Grain Size At Raw Materials Stage | Normalized Grain Count of NdFeB Coarse Magnet Powder in the Bonded Magnet (×10$^9$ pieces/m$^2$) | Irreversible Loss (%) (Environment Temperature: 120° C.) |
|---|---|---|---|---|---|---|
| 4-1 | 882 | 98 | 0 | 97 | 1.50 | −22.1 |
| 4-2 | 882 | 93 | 5 | 97 | 1.40 | −19.7 |
| 4-3 | 882 | 88 | 10 | 97 | 1.35 | −16.3 |
| 4-4 | 882 | 83 | 15 | 97 | 1.15 | −5.9 |
| 4-5 | 882 | 78 | 20 | 97 | 1.00 | −4.3 |
| 4-6 | 882 | 68 | 30 | 97 | 0.80 | −3.5 |
| 4-7 | 1470 | 78 | 20 | 97 | 1.30 | −11.8 |
| 4-8 | 294 | 78 | 20 | 97 | 0.70 | −3.1 |

Heat kneading temperature: 120° C., magnetic field molding conditions: 150° C.
Co-less R2 d-HDDR anisotropic magnet powder composition: $Nd_{12.7}Dy_{0.2}Fe_{bal}Ga_{0.2}Nb_{0.2}B_{6.3}$ (at %)

What is claimed is:

1. A composite rare-earth anisotropic bonded magnet, comprising:

(A) Cobalt-less R1 d-HDDR coarse powder with an average grain diameter of 40-200 μm and having micro-cracks, comprising:

1. Cobalt-less R1 d-HDDR anisotropic magnet powder, obtained by performing a d-HDDR treatment on a cobalt-less R1 alloy of a rare-earth element including yttrium (Y) (hereafter, "R1"), iron (Fe), and boron (B) as the main ingredients and fundamentally not containing cobalt; and 2. #1 surfactant that coats at least one part of the grain surface of said cobalt-less R1 d-HDDR anisotropic magnet powder; and (B) R2 fine magnet powder with an average aspect ratio of 2 or less and average grain diameter 1-10 μm, comprising:

1. R2 anisotropic magnet powder with a maximum energy product (BH)max 240 kJ/m$^3$ or more and with a rare-earth element including yttrium (hereafter, "R2") as one of the principle ingredients; and 2. #2 surfactant that coats at least one part of the grain surface of said R2 anisotropic magnet Powder and (C) a thermosetting resin as binder; wherein the said bonded magnet contains 50-84 wt % of said Co-less R1 d-HDDR coarse magnet powder, 15-40 wt % of said R2 fine magnet powder, and 1-10 wt % of said thermosetting resin; and wherein relative density ($\rho/\rho_{th}$) of the said bonded magnet, which is the ratio of volume density ($\rho$) to theoretical density ($\rho_{th}$), is 91-99%; and wherein normalized grain count of the said Co-less R1 d-HDDR coarse magnet powder in the said bonded magnet, where per unit area apparent grain diameter is 20 μm or less, is $1.2\times10^9$ pieces/m$^2$ or less;

the said composite rare-earth anisotropic bonded magnet having the special characteristics of outstanding magnetic properties and heat tolerance.

2. The composite rare-earth anisotropic bonded magnet recited in claim 1, wherein the above-mentioned R2 anisotropic magnet powder is SmFeN anisotropic magnet powder having samarium (Sm), iron (Fe), and nitrogen (N) as the main ingredients.

3. The composite rare-earth anisotropic bonded magnet recited in claim 1, wherein the above-mentioned R2 anisotropic magnet powder is Co-less R2 d-HDDR anisotropic magnet powder, obtained by performing a d-HDDR treatment on a Co-less R2 alloy having R2, Fe, and B as the main ingredients and fundamentally not containing cobalt.

4. The composite rare-earth anisotropic bonded magnet recited in claim 1 or claim 3, wherein when taking the whole as 100 at %, at least one of the above Co-less R1 d-HDDR anisotropic magnet powder or above R2 anisotropic magnet powder includes 0.05-5 at % of one or more of the rare-earth elements (hereafter, "R3") consisting of dysprosium (Dy), terbium (Tb), neodymium (Nd), and praseodymium (Pr).

5. The composite rare-earth anisotropic bonded magnet recited in claim 1 or claim 3, wherein when taking the whole as 100 at %, at least one of the above Co-less R1 d-HDDR anisotropic magnet powder or above R2 anisotropic magnet powder includes 0.01-1.5 at % of Lanthanum (La).

6. The rare-earth anisotropic bonded magnet recited in claim 1 or claim 3, wherein at least one of the above Co-less R1 d-HDDR anisotropic magnet powder or above Co-less R2 d-HDDR anisotropic magnet powder includes 0.001-6.0 at % of Co.

7. A composite rare-earth anisotropic bonded magnet compound comprising:

(A) Cobalt-less R1 d-HDDR coarse magnet powder having an average grain size of 40-200 μm and having micro-cracks, comprising:

1. Cobalt-less R1 d-HDDR anisotropic magnet powder, obtained by performing a d-HDDR treatment on a cobalt-less R1 alloy of a rare-earth element including yttrium (Y) (hereafter, "R1 "), Fe, and B as the main ingredients and fundamentally not containing cobalt; and 2. #1 surfactant that coats at least one part of the grain surface of said cobalt-less R1 d-HDDR anisotropic magnet powder; and (B) R2 fine magnetic powder with an average aspect ratio of 2 or less and average grain diameter 1-10 μm, comprising:

1. R2 anisotropic magnet powder with a maximum energy product (BH)max of 240 kJ/m$^3$ or more and with a rare-earth element including yttrium (hereafter, "R2") as one of the main ingredients; and 2. #2 surfactant that coats at least one part of the grain surface of said R2 anisotropic magnet powder; and (C) a thermosetting resin as binder; wherein the said compound contains 50-84 wt % of said Co-less R1 d-HDDR coarse magnet powder, 15-40 wt % of said R2 fine magnet powder, and 1-10 wt % of said thermo setting resin; and the said compound having a composition that direct contact between grains of the said Co-less R1 d-HDDR coarse magnet powder is avoided by enveloping the grains in said thermosetting resin, said thermosetting resin being a ferromagnetic buffer which said R2 fine magnet powder is uniformly dispersed.

8. The composite rare-earth anisotropic bonded magnet compound recited in claim 7, wherein the above R2 anisotropic magnet powder is SmFeN anisotropic magnet powder having Sm, Fe, and N as the main ingredients.

9. The composite rare-earth anisotropic bonded magnet compound recited in claim 7, wherein the above R2 anisotropic magnet powder is Co-less R2 d-HDDR anisotropic magnet powder obtained by performing a d-HDDR treatment on a Co-less R2 alloy having R2, Fe, and B as the main ingredients and fundamentally not containing cobalt.

10. The composite rare-earth anisotropic bonded magnet compound recited in claim 7 or claim 9, wherein when taking the whole as 100 at %, at least one of the above Co-less R1 d-HDDR anisotropic magnet powder or above R2 anisotropic magnet powder includes 0.05-5 at % of one or more of the rare-earth elements (hereafter, "R3") consisting of dysprosium (Dy), terbium (Tb), neodymium (Nd), and praseodymium (Pr).

11. The composite rare-earth anisotropic bonded magnet compound recited in claim 7 or claim 9, wherein when taking the whole as 100 at %, at least one of the above Co-less R1 d-HDDR anisotropic magnet powder or above R2 anisotropic magnet powder includes 0.01-1 at % of La.

12. The composite rare-earth anisotropic bonded magnet compound recited in claim 7 or claim 9, wherein either the above Co-less R1 d-HDDR anisotropic magnet powder or above Co-less R2 d-HDDR anisotropic magnet powder includes 0.001-6.0 at % of Co.

* * * * *